US007461646B2

(12) United States Patent
Jones

(10) Patent No.: US 7,461,646 B2
(45) Date of Patent: Dec. 9, 2008

(54) BOLT FOR PNEUMATIC PAINTBALL GUN

(75) Inventor: Danial Jones, Latrobe, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 3 days.

(21) Appl. No.: 11/677,521

(22) Filed: Feb. 21, 2007

(65) Prior Publication Data

US 2007/0209650 A1 Sep. 13, 2007

Related U.S. Application Data

(60) Provisional application No. 60/780,794, filed on Mar. 8, 2006.

(51) Int. Cl.
*F41B 11/32* (2006.01)

(52) U.S. Cl. ..... 124/77; 124/73; 42/69.02

(58) Field of Classification Search ..... 124/71–77; 42/69.02

See application file for complete search history.

(56) References Cited

U.S. PATENT DOCUMENTS 2,116,860 A 5/1938 Blaylock et al.

(Continued)

FOREIGN PATENT DOCUMENTS

AU 3856993 12/1993

(Continued)

OTHER PUBLICATIONS

CO2 Dynamics, http://www.warpig.com/paintball/technical/gasses/co2dynamics.shtml, Jan. 27, 1999.

(Continued)

*Primary Examiner*—Troy Chambers
(74) *Attorney, Agent, or Firm*—Simple IP Law, P.C.; Craig R. Rogers

(57) ABSTRACT

A bolt assembly for a paintball gun preferably includes a valve stem having an output port that can supply compressed gas to a compressed gas storage chamber. A bolt is preferably slidably mounted on the valve stem to move between a forward and a rearward position. The bolt can include one or more bolt ports configured to communicate compressed gas from the compressed gas storage chamber to a forward end of the bolt for launching a paintball when the bolt is in the forward position. When the bolt is in a rearward position, the bolt ports preferably communicate compressed gas from the outlet port of the valve stem into the compressed gas storage chamber. A sealing member can be arranged on the valve stem in communication with the bolt to prevent compressed gas in the compressed gas storage chamber from entering a forward bolt chamber when the bolt is in the rearward position and to permit compressed gas to enter the forward bolt chamber through the bolt ports when the bolt is in the forward position. A flow control member is preferably slidably arranged on the valve stem and configured to permit a flow of compressed gas from the valve stem output port into the compressed gas storage chamber when the flow control member is in a first position and to restrict or prevent the flow of compressed gas from the valve stem output port into the compressed gas storage chamber when the flow control member is in a second position.

20 Claims, 20 Drawing Sheets

U.S. PATENT DOCUMENTS

| | | | | | |
|---|---|---|---|---|---|
| 2,304,320 | A | | 12/1942 | Tratsch | |
| 2,554,116 | A | | 5/1951 | Monner | |
| 2,568,432 | A | | 9/1951 | Cook | |
| 2,594,240 | A | | 4/1952 | Wells | |
| 2,634,717 | A | | 4/1953 | Junkin | |
| 2,817,328 | A | | 12/1957 | Gale | |
| 2,834,332 | A | | 5/1958 | Guthrie | |
| 2,845,055 | A | | 7/1958 | Collins et al. | |
| 2,845,805 | A | | 8/1958 | Collins et al. | |
| 3,089,476 | A | | 5/1963 | Wolverton | |
| 3,192,915 | A | | 7/1965 | Norris et al. | |
| 3,662,729 | A | | 5/1972 | Henderson | |
| 3,695,246 | A | | 10/1972 | Filippi et al. | |
| 3,788,298 | A | | 1/1974 | Hale | |
| 3,915,143 | A | | 10/1975 | Waller | |
| 3,921,980 | A | | 11/1975 | Artzer | |
| 4,009,536 | A | | 3/1977 | Wolff | |
| 4,038,961 | A | | 8/1977 | Olofsson | |
| 4,094,294 | A | | 6/1978 | Speer | |
| 4,269,163 | A | | 5/1981 | Feith | |
| 4,362,145 | A | | 12/1982 | Stelcher | |
| 4,730,407 | A | | 3/1988 | DeCarlo | |
| 4,770,153 | A | | 9/1988 | Edelman | |
| 4,819,609 | A | | 4/1989 | Tippman | |
| 4,899,717 | A | | 2/1990 | Rutten et al. | |
| 4,936,282 | A | * | 6/1990 | Dobbins et al. | 124/74 |
| 5,063,905 | A | | 11/1991 | Farrell | |
| 5,083,392 | A | | 1/1992 | Bookstaber | |
| 5,228,427 | A | | 7/1993 | Gardner, Jr. | |
| 5,257,614 | A | * | 11/1993 | Sullivan | 124/73 |
| 5,261,384 | A | | 11/1993 | Hu | |
| 5,280,778 | A | | 1/1994 | Kotsiopoulos | |
| 5,285,765 | A | | 2/1994 | Lee | |
| 5,333,594 | A | | 8/1994 | Robinson | |
| 5,335,594 | A | | 8/1994 | Karlyn et al. | |
| 5,337,726 | A | | 8/1994 | Wood | |
| 5,339,791 | A | * | 8/1994 | Sullivan | 124/73 |
| 5,349,938 | A | * | 9/1994 | Farrell | 124/73 |
| 5,383,442 | A | * | 1/1995 | Tippmann | 124/76 |
| 5,413,083 | A | | 5/1995 | Jones | |
| 5,462,042 | A | | 10/1995 | Greenwell | |
| 5,497,758 | A | | 3/1996 | Dobbins et al. | |
| 5,515,838 | A | | 5/1996 | Anderson | |
| 5,572,982 | A | | 11/1996 | Williams | |
| 5,613,483 | A | | 3/1997 | Lukas et al. | |
| 5,727,538 | A | | 3/1998 | Ellis | |
| 5,769,066 | A | | 6/1998 | Schneider | |
| 5,778,868 | A | * | 7/1998 | Shepherd | 124/76 |
| 5,878,736 | A | | 3/1999 | Lotuaco, III | |
| 5,881,707 | A | | 3/1999 | Gardner, Jr. | |
| 5,967,133 | A | | 10/1999 | Gardner, Jr. | |
| 6,003,504 | A | | 12/1999 | Rice et al. | |
| 6,035,843 | A | | 3/2000 | Smith et al. | |
| 6,065,460 | A | | 5/2000 | Lotuaco, III | |
| 6,142,136 | A | | 11/2000 | Velasco | |
| 6,343,599 | B1 | | 2/2002 | Perrone | |
| 6,349,711 | B1 | | 2/2002 | Perry et al. | |
| 6,474,326 | B1 | | 11/2002 | Smith et al. | |
| 6,516,791 | B2 | | 2/2003 | Perrone | |
| 6,520,172 | B2 | | 2/2003 | Perrone | |
| 6,532,949 | B1 | | 3/2003 | McKendrick | |
| 6,557,542 | B1 | | 5/2003 | Orr | |
| 6,601,780 | B1 | * | 8/2003 | Sheng | 239/337 |
| 6,626,165 | B1 | | 9/2003 | Bhogal | |
| 6,637,421 | B2 | | 10/2003 | Smith et al. | |
| 6,644,295 | B2 | | 11/2003 | Jones | |
| 6,644,296 | B2 | | 11/2003 | Gardner, Jr. | |
| 6,701,909 | B2 | | 3/2004 | Tiberius et al. | |
| 6,708,685 | B2 | * | 3/2004 | Masse | 124/75 |
| 6,763,822 | B1 | | 7/2004 | Styles | |
| 6,820,606 | B1 | | 11/2004 | Duffey | |
| 6,843,388 | B1 | | 1/2005 | Hollars | |
| 6,901,923 | B2 | * | 6/2005 | Jones | 124/77 |
| 2001/0042543 | A1 | | 11/2001 | Perrone | |
| 2002/0046748 | A1 | | 4/2002 | Hernandez | |
| 2002/0096164 | A1 | | 7/2002 | Perrone | |
| 2002/0170551 | A1 | | 11/2002 | Kotsiopoulos et al. | |
| 2002/0170552 | A1 | | 11/2002 | Gardner, Jr. | |
| 2003/0005918 | A1 | | 1/2003 | Jones | |
| 2004/0065310 | A1 | * | 4/2004 | Masse | 124/75 |
| 2004/0237954 | A1 | | 12/2004 | Styles et al. | |
| 2004/0255923 | A1 | | 12/2004 | Carnell et al. | |
| 2005/0115550 | A1 | | 6/2005 | Jones | |
| 2005/0115551 | A1 | * | 6/2005 | Carnall et al. | 124/71 |
| 2005/0115552 | A1 | | 6/2005 | Dobbins | |
| 2005/0121014 | A1 | | 6/2005 | Monks et al | |
| 2006/0011186 | A1 | | 1/2006 | Jones | |
| 2006/0011188 | A1 | | 1/2006 | Jones et al. | |
| 2007/0017497 | A1 | * | 1/2007 | Masse | 124/73 |
| 2007/0151548 | A1 | * | 7/2007 | Long | 124/73 |
| 2007/0151549 | A1 | * | 7/2007 | Wood | 124/73 |

FOREIGN PATENT DOCUMENTS

| | | |
|---|---|---|
| GB | 2146416 | 4/1985 |
| GB | 2313655 | 12/1997 |
| GB | 2391925 | 2/2004 |
| JP | 1179898 | 7/1989 |
| JP | 7004892 | 1/1995 |
| WO | WO9726498 | 7/1997 |

OTHER PUBLICATIONS

Techno Paintball—information reviews, articles, forum auction and chat at http://technopaintball.com/ matrixreview.htm, 2 pages, 2001.
Matrix—Main Body Assembly & Parts Listing at http://www.directpaintball.com/pics/diablomatrix/matrixparts.gif, 3 pages, May 5, 2003.
Lot of 3 CO2 bottles, Ebay Sale Apr. 13, 2005.

* cited by examiner

100A

BOLT FOR PNEUMATIC PAINTBALL GUN

This application is related to, and claims priority from, U.S. Provisional Patent Application Ser. No. 60/780,794, filed Mar. 8, 2006; and is further related to, and claims priority from, co-pending U.S. patent application Ser. Nos. 10/695,049, filed Oct. 27, 2003; Ser. No. 10/869,829, filed Jun. 15, 2004; Ser. No. 11/056,938, filed Feb. 11, 2005; Ser. No. 11/374,930, filed Mar. 13, 2006; and Ser. No. 11/468,695 filed Aug. 30, 2006, the contents of each of which are incorporated herein by reference, in their entirety.

BACKGROUND OF THE INVENTION

1. Field of the Invention

This invention relates generally to pneumatic paintball guns ("markers") and their operating components. More particularly, this invention relates to a pneumatic paintball gun and the pneumatic components used to load a paintball into and fire it from the paintball gun.

2. Related Art

In the sport of paintball, it is generally desirable to have a marker that is as small and light as possible. Smaller and lighter markers increase a players' mobility. Players benefit from increased mobility by being able to move more quickly from bunker to bunker, making it easier to avoid being hit. Further, in the sport of paintball, the marker is treated as an extension of the body such that a hit to the marker counts as a hit to the player. It is desirable, therefore, to have a paintball gun with as small a profile as possible while substantially maintaining or improving performance characteristics of the marker, such as firing rate, accuracy, and gas efficiency. The size of the paintball gun is generally related to the size and number of operating components that must be housed within the paintball gun body.

It is further desirable to have a paintball marker that includes fewer, less complex, and less expensive, operating components and that can be more easily manufactured. The cost savings can then be passed on to the consumer. The industry is in need of a small, light, and inexpensive paintball marker that provides reliable and efficient operation.

SUMMARY OF THE INVENTION

In one embodiment of the present invention, an improved bolt for a pneumatic paintball gun can include a fixed valve stem, a moveable bolt, and a moveable flow control member. The fixed valve stem preferably comprises an inlet port that receives compressed gas from a compressed gas source and communicates it into an internal passage of the valve stem. An outlet port is preferably arranged in the valve stem forward of the inlet port to communicate the compressed gas from the internal passage into an internal bolt chamber. The internal passage therefore preferably communicates the compressed gas from the inlet port to the outlet port. A sealing member is preferably arranged near a forward end of the valve stem surrounding an outer perimeter of the valve stem.

A bolt is preferably mounted on the valve stem and configured to slide between a rearward (open or loading) position and a forward (closed or firing) position to operate the pneumatic paintball gun. The bolt preferably comprises a substantially hollow, cylindrical-like member having a plurality of ports arranged through a sidewall thereof. In a rearward position, compressed gas from the outlet port of the valve stem is communicated into an internal chamber of the bolt and from the bolt into a compressed gas storage area surrounding the bolt through the bolt ports. In a forward position, the bolt ports preferably slide past (or at least partially past) the sealing member arranged on the valve stem to communicate the compressed gas from the compressed gas storage area into a forward passage in the bolt to launch a paintball from the paintball gun.

The bolt preferably includes a forward and a rearward piston surface area. A quantity of compressed gas is preferably selectively supplied and vented from a forward piston surface area through a mechanical or electro-pneumatic valving mechanism. When gas is supplied to the forward piston surface area, the bolt is held rearward in an open position. When gas is vented away from the forward surface area, compressed gas pressure from the compressed gas storage area urges the bolt forward into a firing position. The firing mechanism preferably consists of the valve stem sealing member arranged in communication with the inner surface of the bolt. The bolt ports preferably provide one or more firing ports arranged to communicate compressed gas into a forward end of the bolt to launch a paintball when the bolt is in its firing position.

The flow of compressed gas into the compressed gas storage area can be restricted or prevented during a firing operation to increase gas efficiency of the paintball gun. More particularly, a flow control member is preferably slidably arranged on a portion of the valve stem. The flow control member is preferably configured to open and close the outlet port of the valve stem. A biasing force can be applied to the flow control member to urge it to a forward position in which it cuts off (or substantially cuts off) the supply of compressed gas from the outlet port into the internal bolt chamber (and hence the compressed gas storage area). The biasing force can be pneumatic or it can be a spring force. The bolt can be configured to urge the flow control member into a rearward (open) position when the bolt is in its open position. In this manner, compressed gas can be supplied into the compressed gas storage chamber during a loading operation and prevented from entering the compressed gas storage chamber during a firing operation, thereby improving gas efficiency.

In operation, compressed gas is preferably supplied to a paintball gun incorporating the improved bolt from a compressed gas source through a pressure regulator. The compressed gas is preferably directed from the pressure regulator to a supply port that communicates with the inlet port of the valve stem for feeding the compressed gas storage area. The compressed gas supplied to the supply port can come directly from the pressure regulator or via a valving mechanism. The compressed gas supplied to the valve stem is preferably transmitted through the valve stem to an outlet port.

Compressed gas supplied to the valving mechanism is preferably transferred through the valving mechanism to the forward surface area of the bolt piston when the valving mechanism is in a neutral (non-actuated) position. This compressed gas acts on the forward bolt piston surface area to force the bolt into a rearward position. While the bolt is in a rearward position, a paintball is allowed to load into a breech of the paintball gun from the feed tube. In addition, while the bolt is rearward, the flow control member is preferably held open and the gas outlet port is preferably allowed to rapidly transmit compressed gas into the compressed gas storage area via the bolt's rearward internal passageway.

A trigger mechanism is preferably configured to operate the valving mechanism. When the trigger is depressed, the valving mechanism is preferably actuated to vent compressed gas away from the forward piston surface area of the bolt. Compressed gas is preferably applied to a rearward surface area of the bolt piston. The rearward surface area of the bolt piston can be arranged, for example, in the compressed gas storage area or at a rearward end of the bolt. The compressed gas applied to the rearward surface area of the bolt piston can therefore be supplied from the compressed gas storage area or from a separate supply port. When the compressed gas is vented from the forward bolt piston surface area, the pressure applied to the rearward bolt piston surface area preferably causes the bolt to move to a forward position.

When the bolt transitions to its forward position, the bolt ports (preferably arranged near a rearward end of the bolt) transition past (or partially past) a sealing member arranged on the valve stem. Compressed gas from the compressed gas storage area is thereby permitted to enter a forward bolt passage through the bolt firing ports to launch a paintball from the marker. In addition, as the bolt transitions to the firing position, the flow control member is preferably driven forward, either linked to the movement of the bolt or driven separately by a spring member or other biasing force. When the flow control member moves forward, it preferably closes off the outlet port and blocks (or restricts) the flow of compressed gas from the valve stem into the compressed gas storage area.

The valving mechanism can be a solenoid valve (such as a three-way, four-way, or other solenoid valve), a mechanical valve, or other valving mechanism. In the case of a solenoid valve, an electronic circuit is preferably provided to control the operation of the solenoid valve based on actuation of a trigger mechanism. A switch, such as a microswitch or other switching device, is preferably arranged in communication with the trigger to send an actuation signal to the electronic circuit in response to a pull of the trigger. A power source is also preferably provided to supply power to the electronic circuit and solenoid valve. The valving mechanism preferably vents compressed gas away from a forward bolt piston surface area in response to a firing signal from the circuit board. In the case of a mechanical valve, the mechanical valve preferably communicates with the trigger to vent the compressed gas away from the forward bolt piston surface area in response to a trigger pull.

In one embodiment, vent ports can also be arranged through sidewalls of the bolt behind a rearward surface of the pneumatic piston to prevent pressurized gas build-up in the pneumatic cylinder behind the bolt piston. The chamber in communication with the rearward piston surface of the bolt can thereby be vented to atmosphere through the forward internal bolt passage. This reduces the force necessary to drive the bolt to its rearward position.

Various other aspects, embodiments, and configurations of this invention are also possible without departing from the principles disclosed herein. This invention is therefore not limited to any of the particular aspects, embodiments, or configurations described herein.

BRIEF DESCRIPTION OF THE DRAWINGS

The foregoing and additional objects, features, and advantages of the present invention will become more readily apparent from the following detailed description of various potential embodiments, made with reference to the accompanying figures, in which.

DETAILED DESCRIPTION

Figure 1:
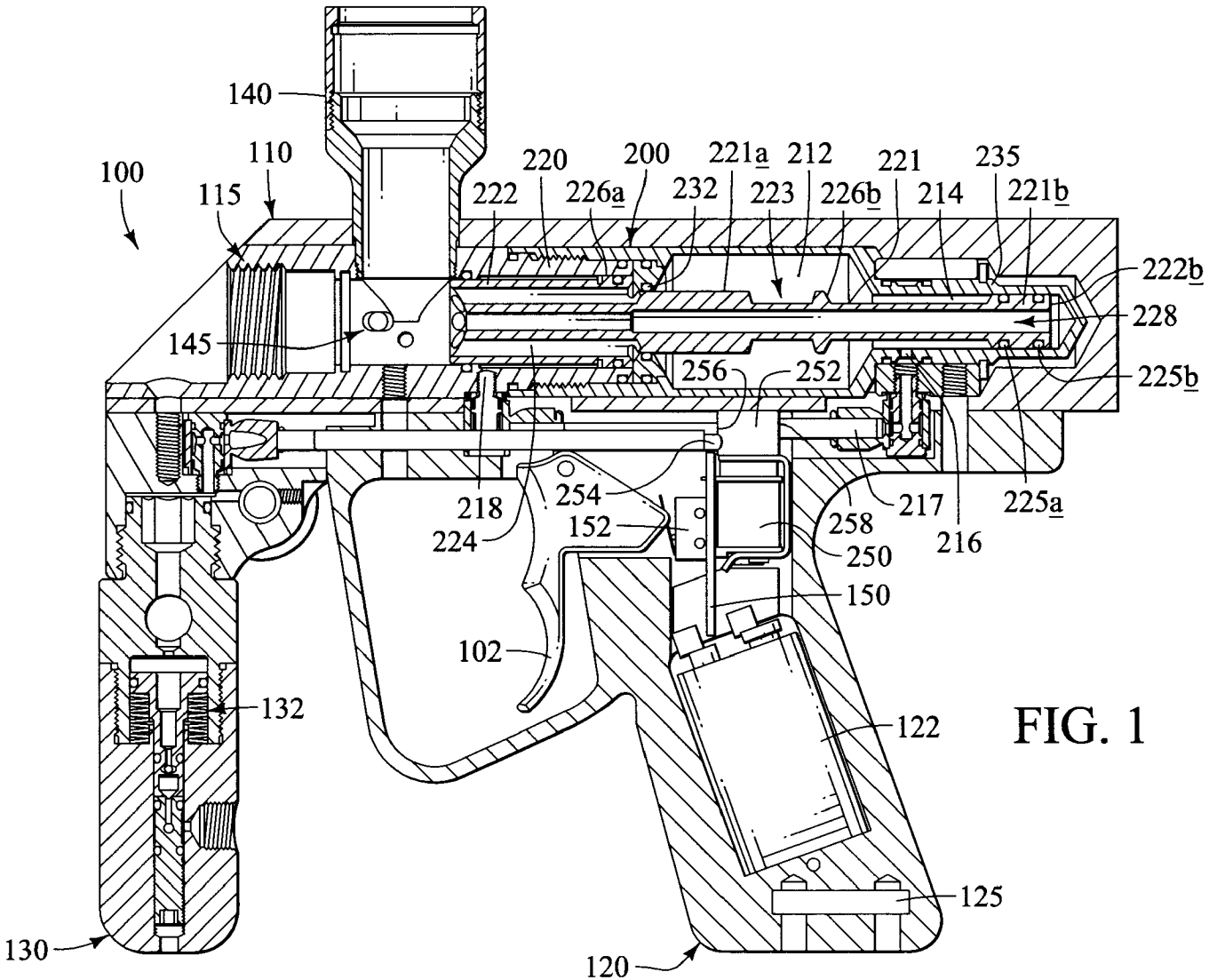
FIG. 1 is a somewhat schematic cross-sectional side view of a paintball gun, shown with a bolt thereof in an rearward (open) position, according to certain principles of the inventions disclosed in applicant's earlier applications.

The accompanying drawings show various embodiments incorporating principles of the present invention. Referring to FIG. 1, a pneumatic paintball gun 100 can be constructed having a body 110 and a grip 120. A foregrip 130 can also be provided. The body 110 and the grip 120 can be formed integrally or separately and can be formed of the same or different materials. The body 110 and the grip 120 are preferably formed of a molded plastic or rubber material, such as ABS plastic, that is durable and shock resistant yet relatively inexpensive.

A pneumatic housing 115 is preferably arranged in the body 110 to house some or all of the pneumatic components, to receive a barrel (not shown), and to receive a feed tube 140. The pneumatic housing 115 is preferably a block or tube formed from a metal such as aluminum, but can be formed of any other metal, plastic, or other material that is sufficiently durable to perform its required functions. The grip 120 and foregrip 130 are preferably secured to the body 110 and the pneumatic housing 115 using screws or other fastening means. A plate 125 can be provided and formed of a rigid material, such as metal. The plate 125 is preferably arranged in the grip 120 to permit secure attachment of a tank receptacle (not shown) for connecting to a compressed gas tank.

The foregrip 130 preferably provides a regulator 132 that can regulating a supply of compressed gas from the compressed gas tank down to a desired operating pressure. In this embodiment, the desired operating pressure is between about 90 to 350 psi. A battery 122 can be arranged in the grip 120 along with a circuit board 150 and a solenoid valve 250. The solenoid valve 250 of this embodiment is preferably a normally-open, three-way solenoid valve.

A pneumatic assembly 200 is preferably arranged in the body 110 and can be connected to and/or include some or all of the pneumatic housing 115. The pneumatic assembly 200 can include a compressed gas storage area 212, a pneumatic cylinder 220, and a guide chamber 214. A bolt 222 is preferably slidably arranged having a first piston surface area 226*a* located within a pneumatic cylinder 220 in a piston and cylinder assembly. The bolt 222 may further include a guide rod 221 that extends through substantially the entire pneumatic assembly 200.

The guide rod 221 can include a firing valve section 221*a* that communicates with a sealing member 232 to prevent compressed gas from entering the bolt 222 from the compressed gas storage area 212 when the bolt 222 is rearward. The guide rod 221 can further include a rearward section 221*b* that slides back and forth within a guide chamber 214 to provide stability for the bolt and also to restrict or prevent the flow of compressed gas into the compressed gas storage area 212 from a supply port 216 when the bolt 222 is forward. A vent channel 228 may be provided through the bolt 222 and guide rod 221 to prevent back pressure from building up on a rearward end 222*b* of the bolt 222 and thereby provide an essentially free-floating bolt arrangement. This reduces the amount of pressure required to recock the bolt 222. The vent channel also reduces the amount of force applied by a forward end 222*a* of the bolt 222 on a paintball, improves gas efficiency, and eliminates the need for a secondary pressure regulator. Alternatively, a vent channel (not shown) may be provided through the body 110 of the gun 100 to vent the rearward chamber area 214 to atmosphere.

With the bolt 222 in an open position, compressed gas from the regulator 132 is supplied to the compressed gas storage area 212 through the supply port 216. The sealing member 232 can communicate between an external surface of the bolt 222 along the firing valve section 221*a* and an inner wall of the pneumatic assembly 200 to prevent compressed gas from entering the bolt 222. The sealing member 232 can, for example, be arranged in a recess of the inner wall (or protrusion from the inner wall) of the pneumatic assembly 200 near a forward end of the compressed gas storage chamber 212.

Alternatively, for example, a bolt port can be arranged through the bolt 222, with an input disposed near a rearward end of the bolt 222, to communicate compressed gas from a rearward end of the compressed gas storage area 212 through the bolt 222 and into communication with a paintball when the bolt transitions to its forward position. In this embodiment, the sealing member 232 could be arranged on the bolt 222 near a rearward end of the compressed gas storage area 212 so as to prevent compressed gas from entering the bolt 222 from the compressed gas storage area 212 when the bolt 222 is open, but to permit compressed gas from the compressed gas storage area 212 to enter the bolt 222 when the bolt is closed.

The solenoid valve 250 preferably selectively supplies compressed gas to and vents compressed gas from the cylinder 220 through the port 218 to move the bolt 222. The solenoid valve 250 preferably comprises a normally-open configuration where compressed gas input into the solenoid valve 250 through an input port 254 is supplied via an output port 256 to the forward piston surface area 226*a* of the bolt 222 to hold the bolt 222 in an open position when the solenoid is de-actuated.

Figure 2:
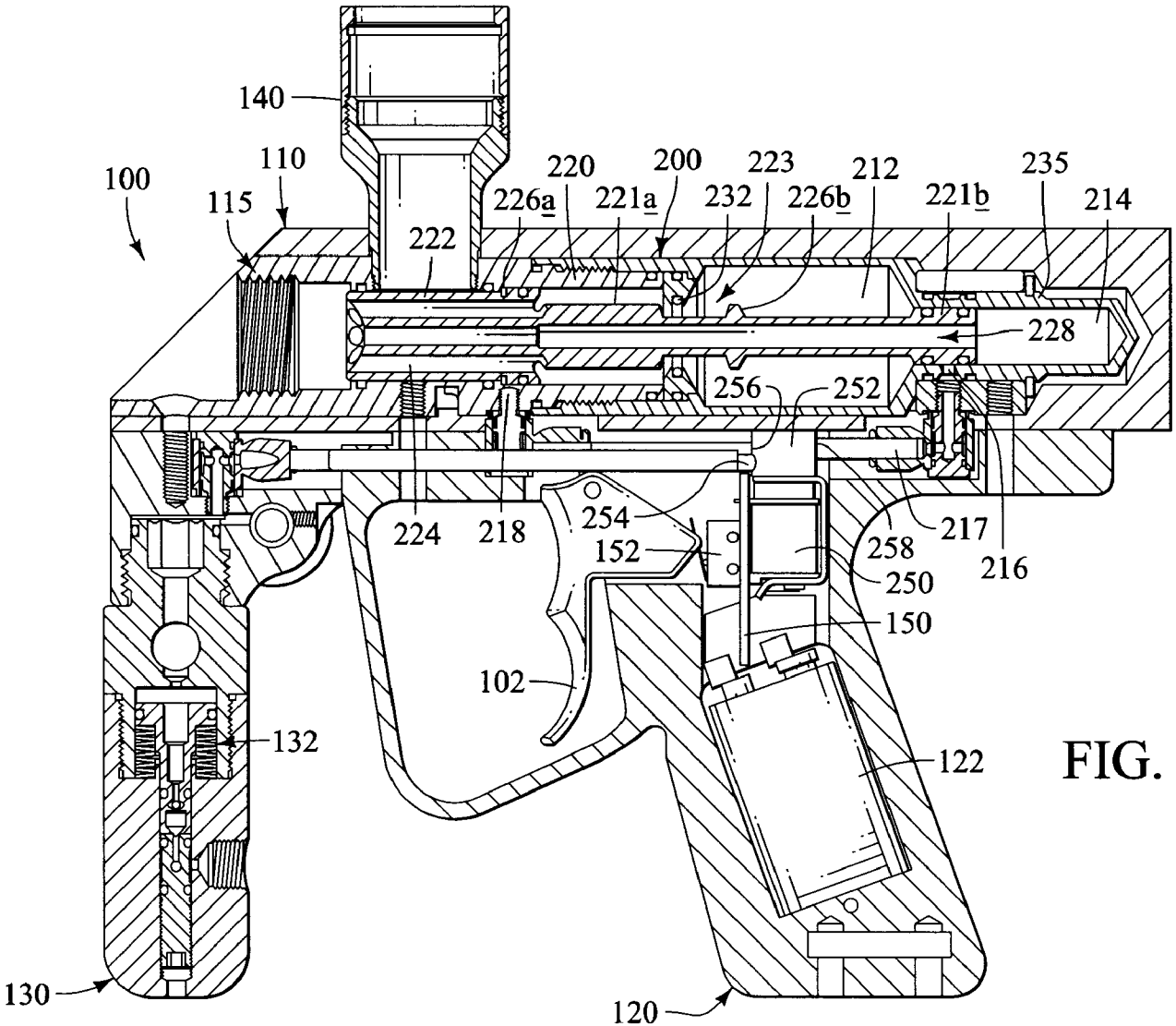
FIG. 2 is a somewhat schematic cross-sectional side view of the paintball gun of FIG. 1, shown with the bolt is disposed in a forward (closed) position.

In response to a trigger pull, a firing signal is preferably sent from the circuit board 150 to the solenoid valve 250 to initiate a firing operation of the paintball gun 100. In response to the firing signal, the solenoid valve 250 preferably vents compressed gas away from the forward piston area 226*a* of the bolt 222. Pressure on an opposing surface area 226*b* of the bolt 222 thereby causes the bolt 222 to transition to a closed position, as shown in FIG. 2. The opposing surface area 226*b* can, for instance, be arranged in the compressed gas storage area 212 as shown in FIGS. 1 and 2.

Alternatively, the opposing surface area 226*b* can be arranged on a rearward end 222*b* of the bolt 222, with compressed gas supplied to the rearward end 222*b* of the bolt 222 through a separate supply channel (not shown). In this alternative embodiment, the vent channel 228 would be omitted to maintain pressure in chamber 214 to function as an air spring. The opposing surface area 226*b* could likewise be positioned anywhere else where it can receive a quantity of compressed gas to force the bolt 222 into a closed position when gas is vented away from the forward surface area 226*a*. The opposing surface area 226*b* preferably has a surface area less than that of the forward surface area 226*a* to prevent the bolt from moving forward until the compressed gas is vented away from the forward surface area 226*a*. Alternatively, a mechanical spring or other biasing member that provides a desired amount of force (preferably less than the amount of force created by the compressed gas on the forward surface area of the bolt 226*a*) could be used to force the bolt 222 into a closed position when compressed gas is vented away from the forward surface area 226*a* of the bolt 222.

Referring now to FIG. 2, with the bolt 222 in the closed position, compressed gas from the compressed gas storage area 212 is permitted to flow into the bolt 222 through channels 223 arranged along an external surface of the bolt 222 and ports 224 arranged to communicate compressed gas from a predetermined location along the exterior of the bolt 222 to a forward end of the bolt 222*a*. While the bolt 222 is in its forward position, entry of compressed gas into the compressed gas storage area 212 from the supply port 216 can be restricted using a glide ring 225*a* arranged on the rearward section of the guide rod 221*b* near a rearward end 222*b* of the bolt 222. A sealing member 225*b* prevents compressed gas from entering the rearward portion of the guide chamber 214 and the vent channel 228. To prevent (rather than restrict)

compressed gas from entering into the chamber during the firing operation, the glide ring 225*a* could be replaced by a sealing member (not shown).

Figure 3:
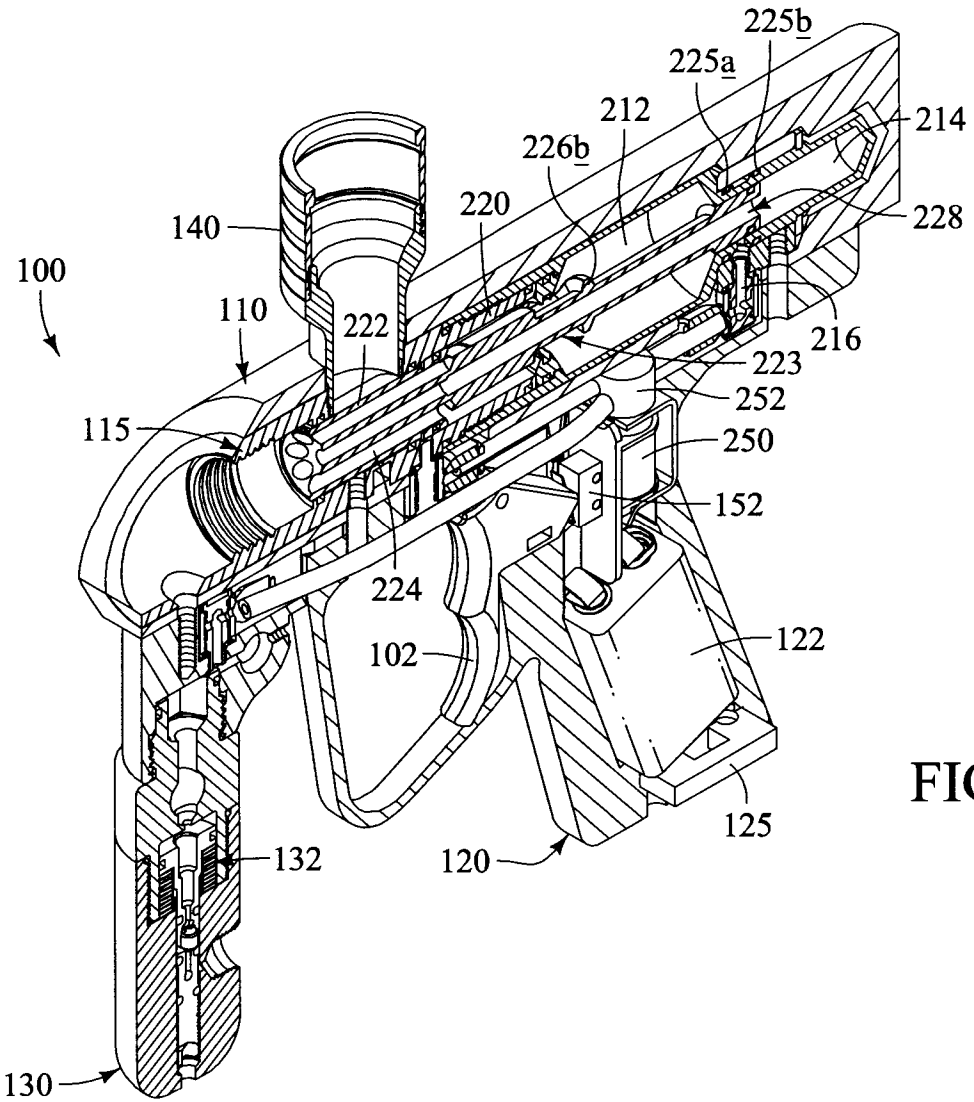
FIG. 3 is a somewhat schematic cross-sectional perspective view of the pneumatic paintball gun illustrated in FIG. 2.

Loading and firing operations of the pneumatic paintball gun 100 will now be described in further detail with reference to FIGS. 1-3. Referring to FIGS. 1, 2, and 3, compressed gas supplied from the regulator 132 to the paintball gun 100 is directed to a manifold 252 arranged in communication with the solenoid valve 250. Compressed gas from the regulator 132 is directed through the manifold to an inlet 254 of the solenoid valve 250. In its normally-open position, the solenoid valve 250 directs compressed gas from the input port 254 to an output port 256 of the manifold 252 to the cylinder 220 and hence the forward bolt piston surface area 226*a*.

Meanwhile, compressed gas from the regulator 132 is also supplied through a second output port 258 of the manifold 252 to a supply port 216, preferably arranged near a rearward end of the compressed gas storage area 212 in a bolt guide cylinder 235. While the bolt 222 is open, compressed gas from the supply port 216 is preferably permitted to rapidly fill the compressed gas storage area 212. A rearward piston surface area 226*b* of the bolt 222 is preferably arranged in or in communication with the compressed gas storage area 212. The forward bolt piston surface area 226*a* is preferably larger than the rearward surface area 226*b*. Thus, in its resting position (e.g., in the absence of a firing signal), the compressed gas supplied to the forward bolt piston surface area 226*a* holds the bolt 222 in an open position against pressure applied to a rearward bolt piston surface area 226*b*. With the bolt 222 in its open (e.g., rearward position), a paintball is permitted to drop from a feed tube 140 into a breech area 145 of the paintball gun 100.

A firing operation of the paintball gun 100 is preferably initiated in response to actuation of a trigger 102. The trigger 102 is preferably configured to initiate a firing operation of the paintball gun 100 through actuation of a microswitch 152 or other switching mechanism when pulled. Actuation of the switching mechanism 152 preferably causes the circuit board 150 to initiate a firing operation by transmitting one or more firing signals to the solenoid valve 250. In the embodiment illustrated in FIGS. 1, 2, and 3, the firing signal is preferably an actuation signal that energizes the solenoid of the solenoid valve 250 for a predetermined duration of time. The trigger 102 could be configured, however to actuate a firing sequence as long as the trigger 102 is pulled, particularly if a mechanical rather than electronic actuation system is utilized.

In response to the firing signal, the solenoid valve 250 preferably vents compressed gas from the forward bolt piston area 226*a*. Pressure applied from the compressed gas storage area 212 to the rearward bolt piston area 226*b* thereby causes the bolt 222 to move to its forward position. As the bolt 222 transitions to its forward position, it forces a paintball that has been loaded in the breech area 145 forward into the rearward end of a barrel (not shown).

In addition, as the bolt 222 approaches its forward position, the channels 223 arranged along the external surface of the bolt 222 slide past the sealing member 232 and allow the compressed gas from the compressed gas storage area 212 to enter into the rearward portion of the cylinder 220. Compressed gas in the rear of the cylinder 220 flows through bolt ports 224 into contact with the paintball in the barrel to cause it to be launched from the gun 100. Also, as the bolt 222 approaches its forward position, a glide ring or sealing member 225*a* slides past the gas supply port 216 to respectively restrict or prevent the flow of compressed gas from the regulator 132 into the compressed gas storage area 212. This can improve the gas efficiency of the paintball gun 100.

Although the embodiment of FIGS. 1, 2, and 3 illustrates the use of an electro-pneumatic valve 250 to control the loading and firing operations of the paintball gun 100, a mechanical valve could be used in place of the solenoid valve 250. Like the solenoid valve 250, the mechanical valve could be configured to supply compressed gas to the forward piston surface area 226*b* through port 218 in a resting position. In response to a pull of the trigger 102, the mechanical valve could be configured to vent the compressed gas away from the forward piston surface area 226*b* to cause the bolt 222 to move forward and perform a firing operation. The trigger 102 could, for example, be directly mechanically coupled to the valve or could communicate with the mechanical valve through one or more intermediate components.

Figure 4:
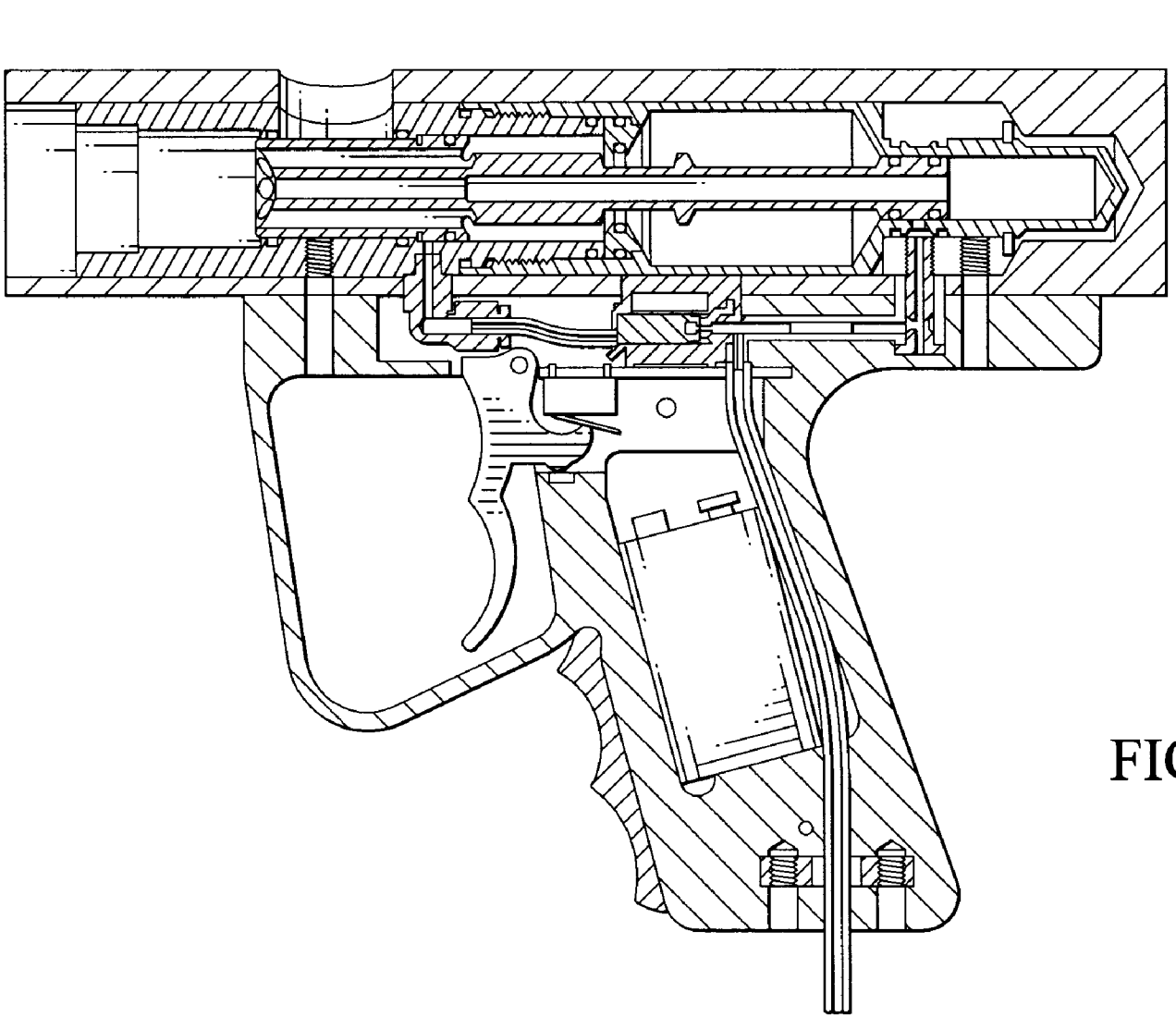
FIG. 4 is a somewhat schematic cross-sectional side view of a paintball gun constructed according to an alternative embodiment.
Figure 5:
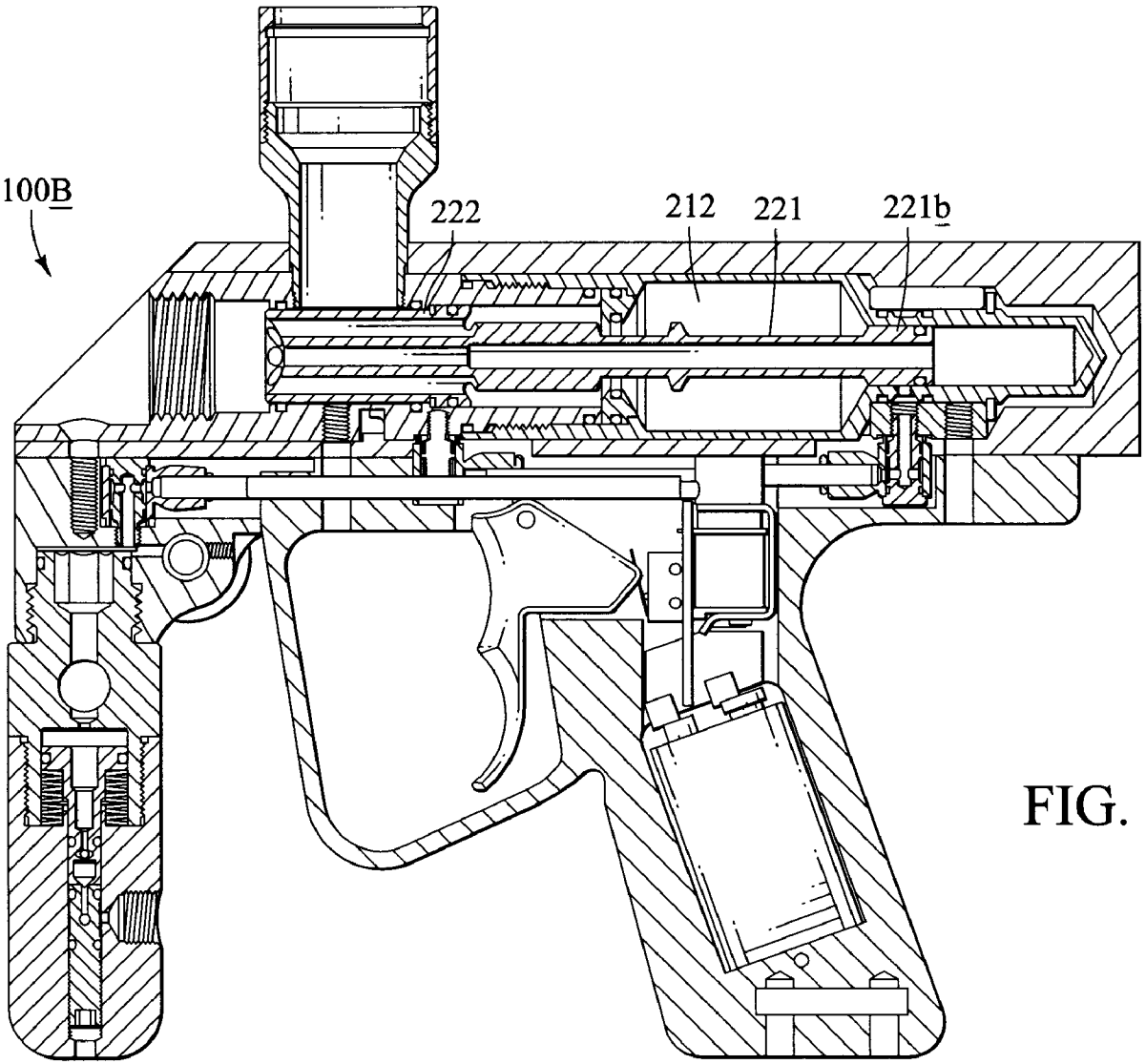
FIG. 5 is a somewhat schematic cross-sectional side view of a paintball gun constructed according to yet another embodiment.

Yet other alternative embodiments of the earlier-described invention are shown in FIGS. 4 and 5. The paintball gun 100A shown in FIG. 4 is constructed in a manner similar to that shown in FIGS. 1, 2, and 3, except, for instance, the absence of a foregrip 130, compressed gas being supplied to the gun through a tube arranged through the grip 120, and that the solenoid valve 250 is arranged in a different physical relationship with respect to the gun body 110. The primary operating features of this embodiment are essentially the same as that previously described, however, and no additional description of this embodiment will therefore be provided.

The paintball gun 100B depicted in FIG. 5 is also similar to that depicted in FIGS. 1-3, except that the rearward end 221*b* of the guide rod 221 does not contain a glide ring or a sealing ring where the glide ring 225*a* is arranged in the earlier-described embodiment. As with the glide ring, compressed gas is permitted to enter the compressed gas storage chamber 212 even when the bolt is in its forward position. The tolerance between the guide rod 221 and the guide chamber 214 can be configured, however, such that the rate of flow of compressed gas into the compressed gas storage chamber 212 can be restricted while the bolt 222 is arranged in its forward position. This can result in improved gas efficiency and make the bolt 222 easier to move to its retracted position.

Various other alternative embodiments are also contemplated. In particular, rather than use a portion of the bolt 222 to restrict or prevent compressed gas from entering the compressed gas storage area 212, other mechanisms could be used to provide this function. For example, a separate piston could be arranged to slide back and forth in the rearward bolt guide area to block or restrict the supply of compressed gas from the supply port 214 into the compressed gas storage area 212. In yet another potential embodiment, a mechanical, pneumatic, or electro-pneumatic pinching member could be provided to pinch a gas supply tube (e.g., tube 217) to prevent or restrict the flow of compressed gas into the compressed gas storage area 212 while the bolt 222 is in the forward position.

Figure 6:
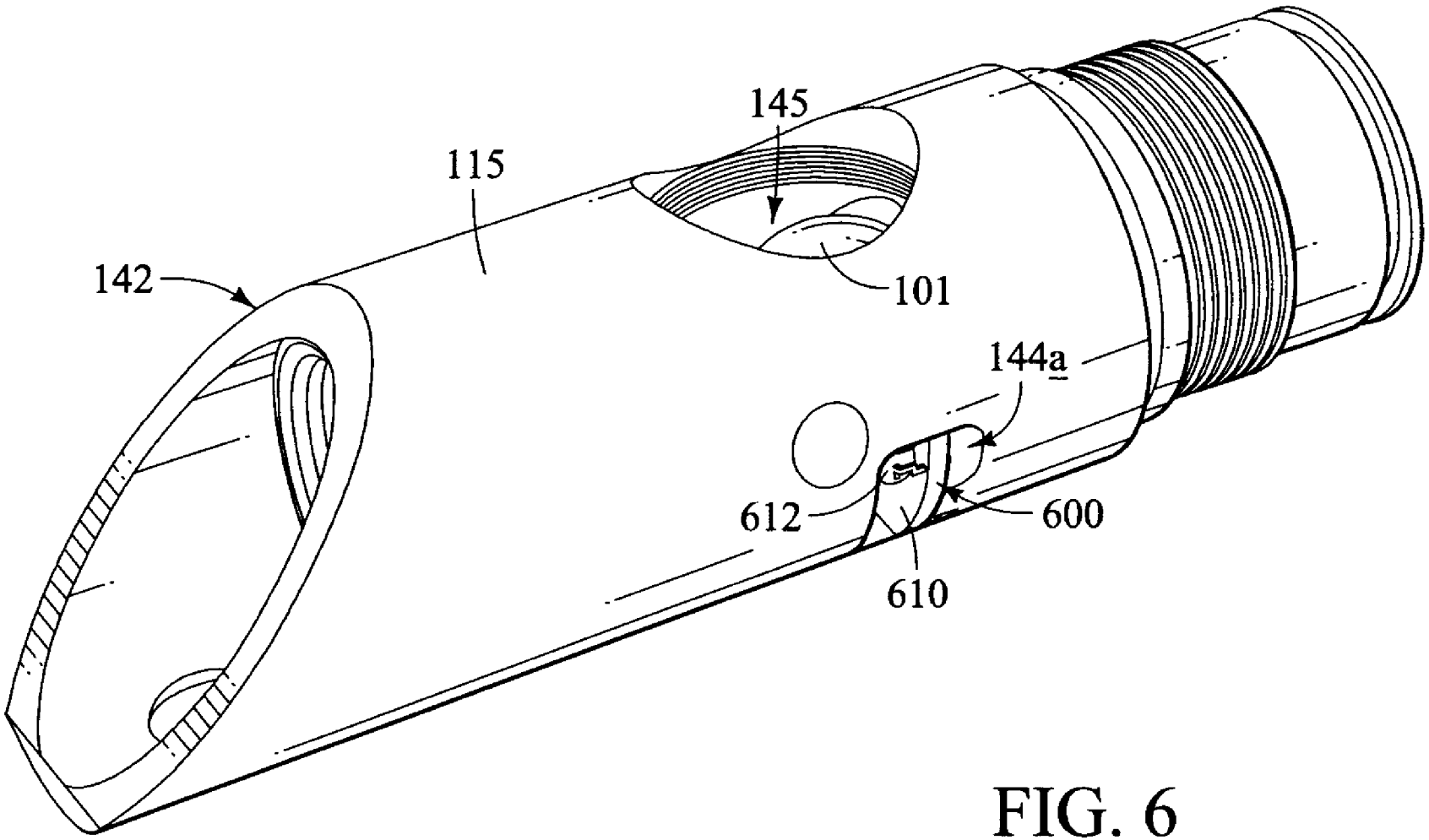
FIGS. 6, 7, and 8 are a somewhat schematic perspective, cross-sectional side, and bottom plan view, respectively, illustrating a paintball detection system arrangement in a breech section of a paintball gun.
Figure 7:
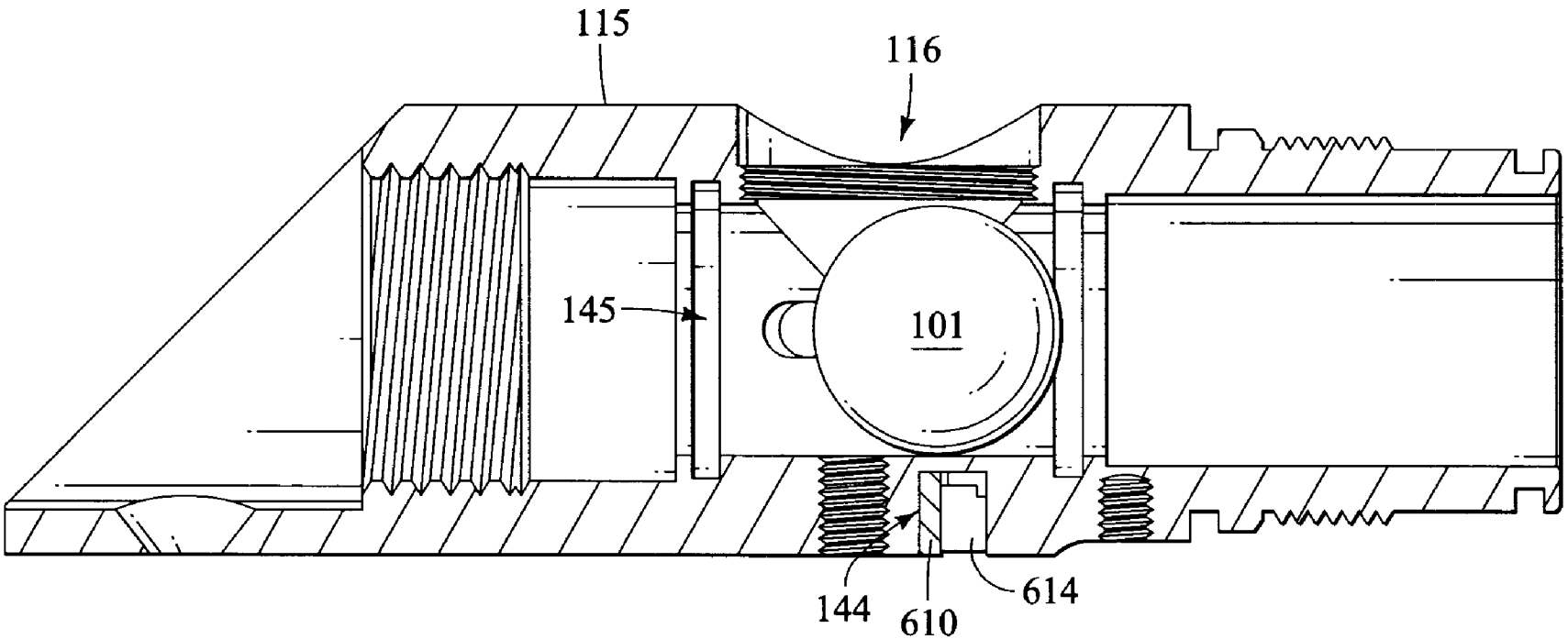
Figure 8:
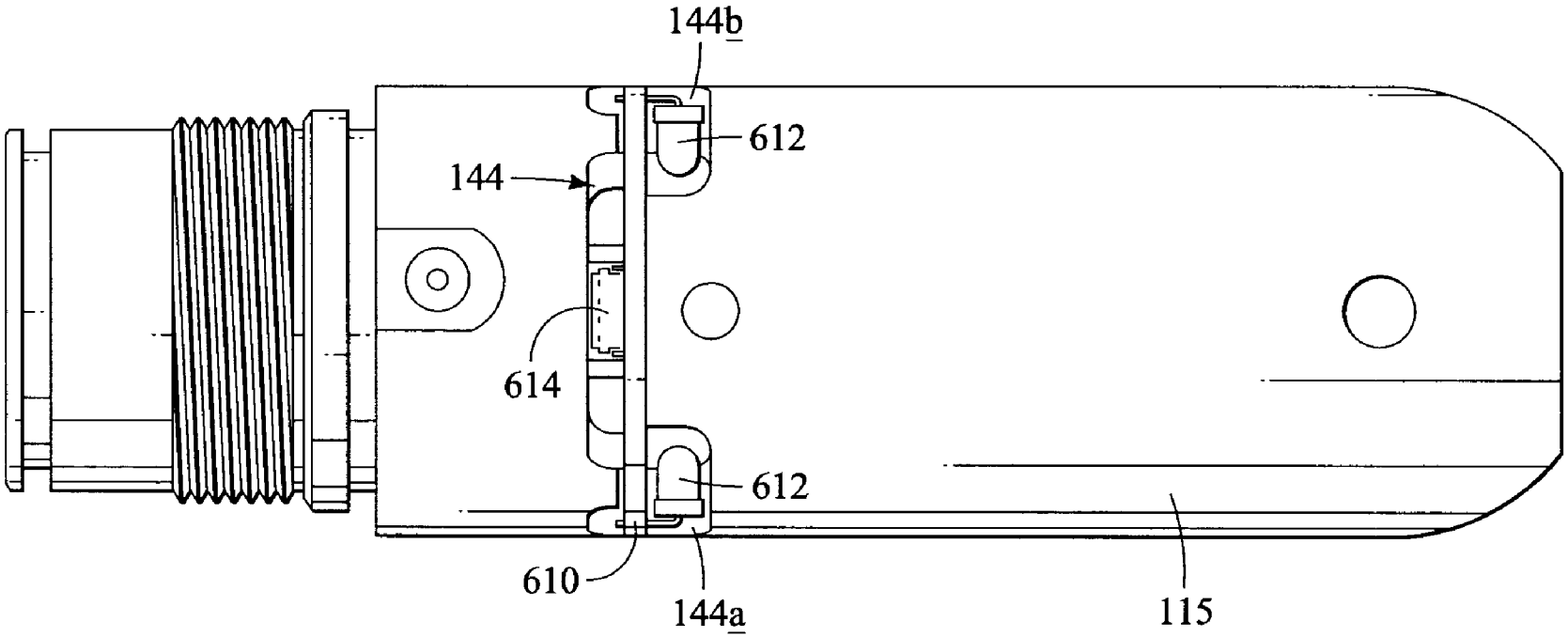

Further aspects of the earlier-described invention are illustrated in FIGS. 6, 7, and 8. Referring to FIGS. 6-9, a paintball detection system 600 can be arranged in communication with a breech area 145 of the paintball gun 100 (see FIG. 1). Most preferably, the paintball detection system 600 contains a break-beam sensor arrangement on a circuit board 610. A breech portion 142 of the pneumatic housing 115 of the paintball gun 100 is preferably provided with a recess or a cutout area 144 to receive the circuit board and opposing cutout regions 144*a*, 144*b* located on opposite sides of the breech area 145 that are configured to receive the break-beam sensors 612.

Figure 9:
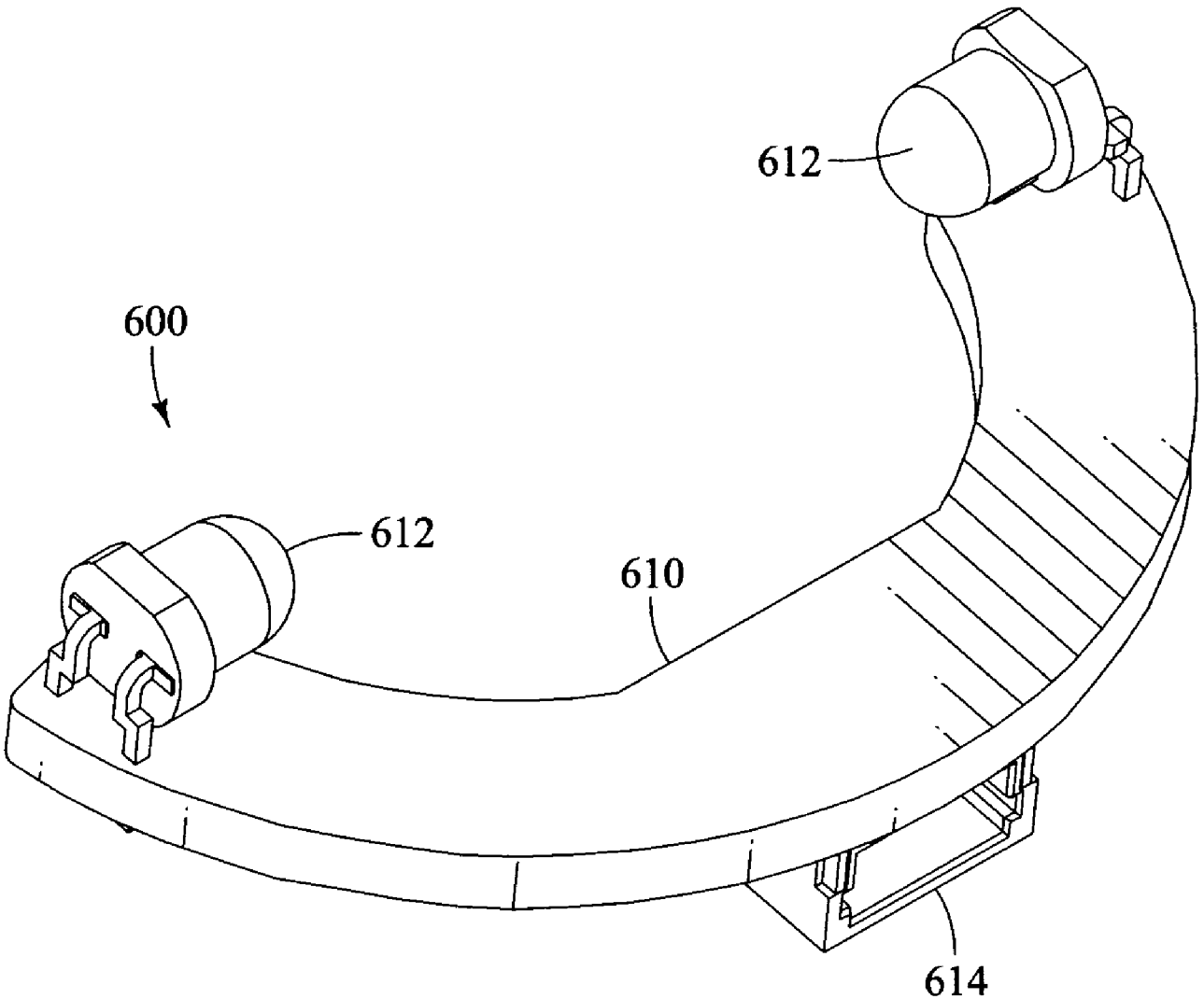
FIG. 9 is a somewhat schematic perspective view of a circuit board and sensor system for the paintball detection system configured for arrangement in the breech section of the paintball gun illustrated in FIGS. 6, 7, and 8.

A preferred circuit board 610 and sensor 612 arrangement for the paintball detection system 600 of FIGS. 6, 7, and 8 is shown in FIG. 9. Referring to FIG. 9, the circuit board 610 preferably comprises the circuitry for controlling the break-beam or other sensors 612 and an electronic communications port 614 for communicating with a circuit board 150 of the paintball gun 100 (see FIG. 1) through wiring or wirelessly. The sensors 612 can be mounted directly to the circuit board 610, as illustrated, or can be connected remotely via wires or wirelessly. In a preferred embodiment, the circuit board 610 is configured having a "C" shape with sensors 612 arranged on opposite arms of the circuit board 610. The circuit board 610 is preferably configured to fit within a recess or cutout 144 in the pneumatic housing and locate the sensors 612 within sensor cutout regions 144*a*, 144*b* in the pneumatic housing 115 on opposite sides of the breech area 145. In the preferred break-beam sensor embodiment, the sensors 612 are preferably configured such that one transmits a beam (or other optical or radio signal) to the other sensor 612 until that signal is interrupted by the presence of a paintball 101 in the breech area 145.

Operation of the paintball detection system 600 according to the foregoing embodiment will now be described in further detail with reference to FIGS. 1 and 6-9. Referring to FIGS. 6-9, with the bolt 222 arranged in a rearward position, a paintball 101 is preferably permitted to drop from the feed tube 140 into the breech area 145 of the paintball gun 100 through the feed tube opening 116. As the paintball 101 enters the breech area 145, it breaks a beam transmitted from one of the sensors 612 to the opposing sensor 612. A signal is then preferably generated by the detection system circuit board 610 to indicate that a paintball 101 has been loaded into the paintball gun 100. Alternatively, the detection system circuit board 610 could be configured to send a signal corresponding to the absence of a paintball 101 from the breech area 145.

The detection system circuit board 610 therefore preferably communicates a signal to the paintball gun circuit board 150 to indicate either the presence or the absence of a paintball 101 in the breech area 145 of the paintball gun 100. In response to this signal, the paintball gun circuit board 150 can preferably be configured to either execute or refrain from executing a firing operation in response to a trigger pull. More specifically, if the detection system circuit board 610 indicates the absence of a paintball 101 from the breech area 145 of the paintball gun 100, the paintball gun circuit board 150 is preferably configured to refrain from executing a firing operation in response to a trigger pull. If a paintball 101 is detected in the breech area 145 of the paintball gun 100, however, the paintball gun circuit board 150 is preferably configured to execute the firing operation in response to a trigger pull.

Figure 10:
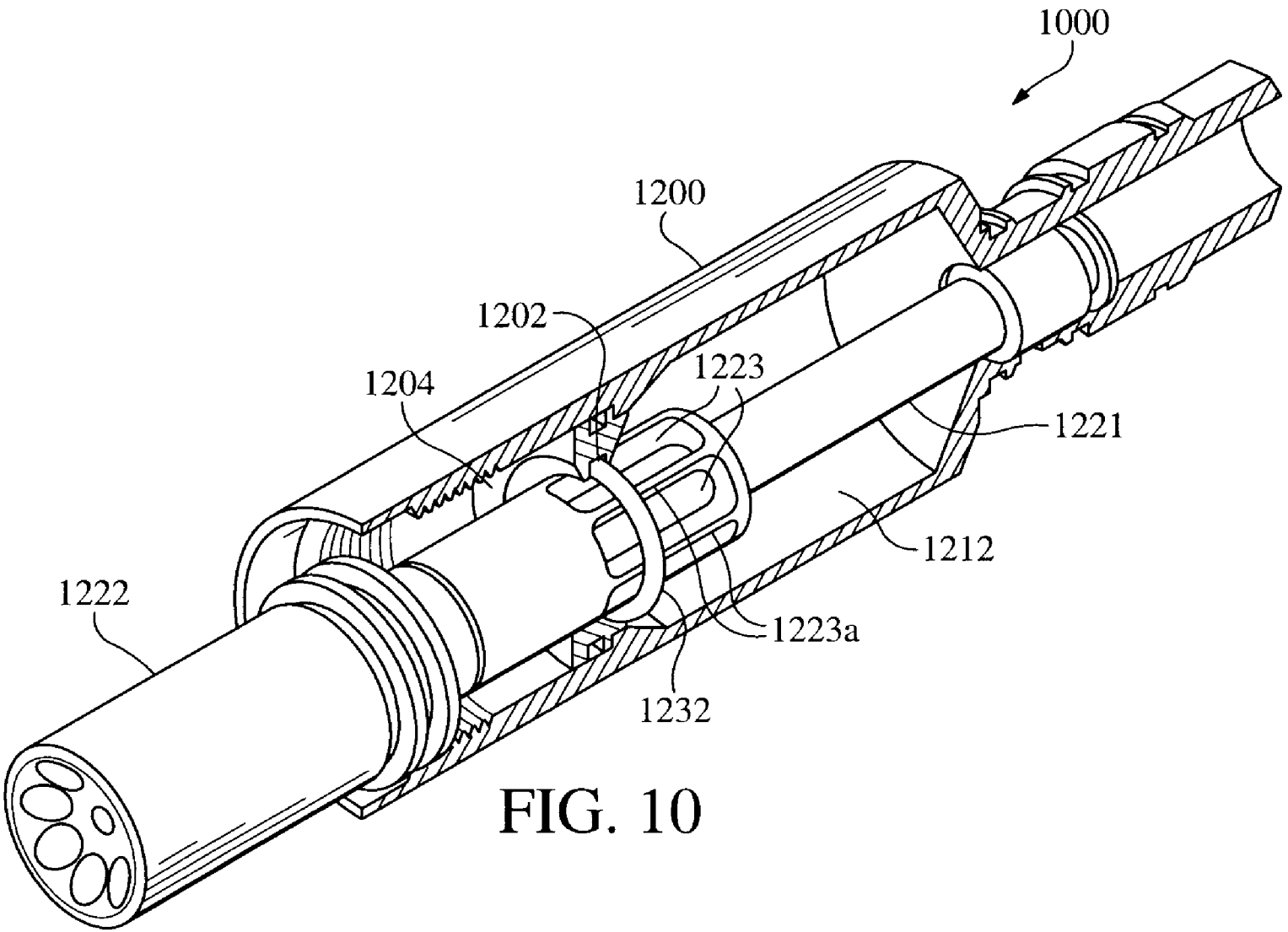
FIG. 10 is a somewhat schematic perspective cross-sectional view of a pneumatic assembly capable of use in the paintball gun of FIG. 1.

FIG. 10 is a somewhat schematic perspective cross-sectional view of a pneumatic assembly 1000 illustrating another aspect of the earlier-described invention. Referring to FIG. 10, a plurality of ribs (or fins) 1223*a* can be formed along a firing valve area 1221*a* of the bolt rod 1221 to retain an O-ring 1232 (or other sealing member) in position during a firing operation of the paintball gun (or other pneumatic launching device). As shown, an O-ring 1232 can be retained in an O-ring retaining groove 1202 in an O-ring retaining member 1204 to provide a sealing member for selectively preventing and permitting compressed gas to enter the bolt 1222 from a compressed gas storage area 1212. In this embodiment, when the bolt 1222 is in a rearward position, the O-ring 1232 seals around an outer surface of the firing valve area 1221*a* of the bolt rod 1221 to prevent compressed gas from escaping into the bolt 1222. When the bolt 1222 transitions to a forward position during a firing operation, however, firing grooves 1223 arranged between the ribs 1223*a* permit compressed gas to escape from the compressed gas storage area 1212 into the bolt 1222 to be released from the paintball gun and launch a paintball. At the same time, however, the ribs 1223*a* prevent the O-ring 1232 from being unseated from its retaining groove 1202 and collapsing into the firing grooves 1223.

Figure 11:
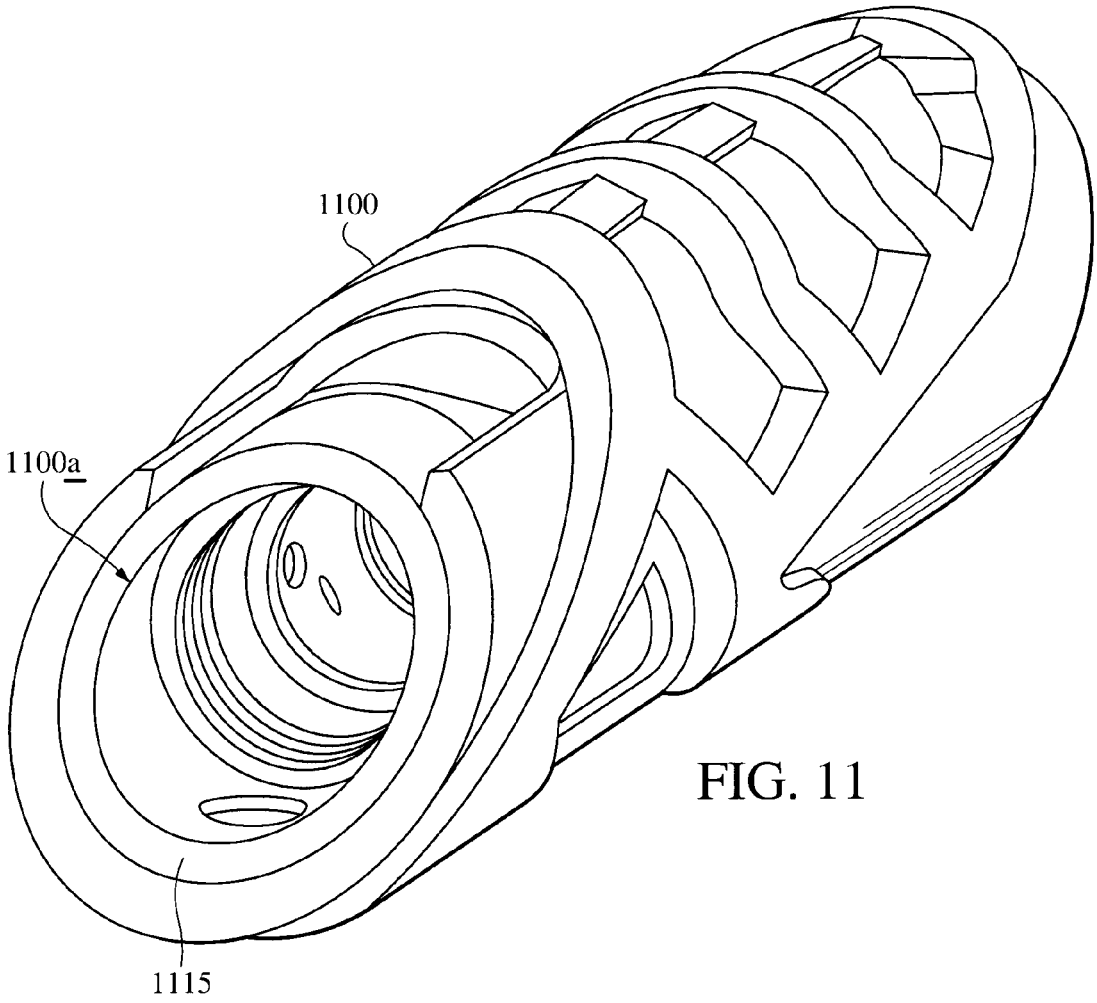
FIG. 11 is a somewhat schematic perspective view of a paintball gun body having an interchangeable external shell.
Figure 12:
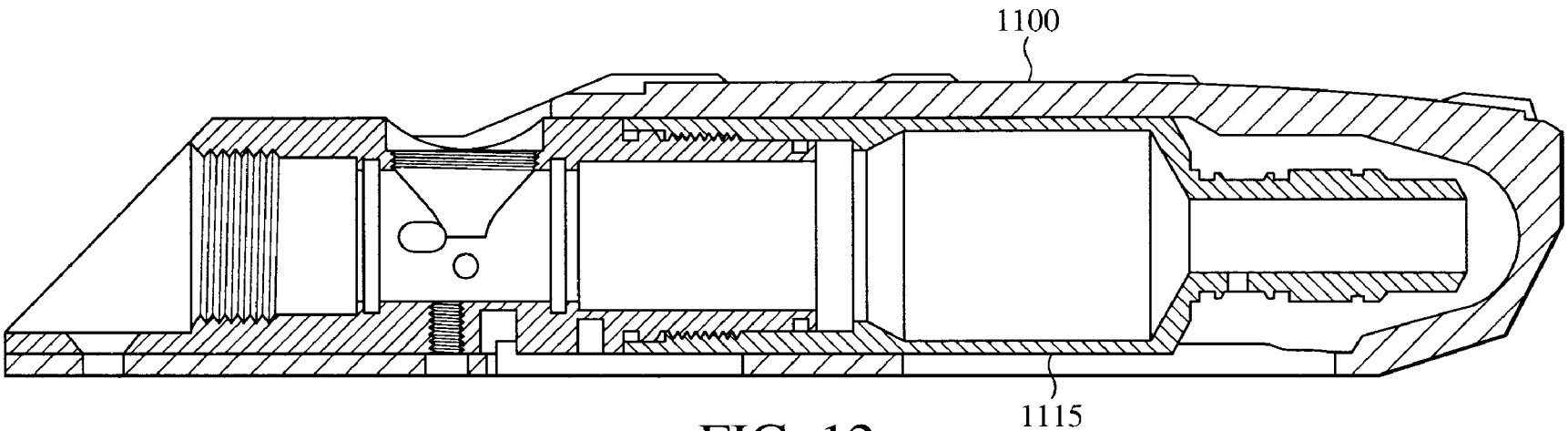
FIG. 12 is a somewhat schematic cross-sectional side view of a paintball gun body with an interchangeable external shell, as shown in FIG. 11.
Figure 13A:
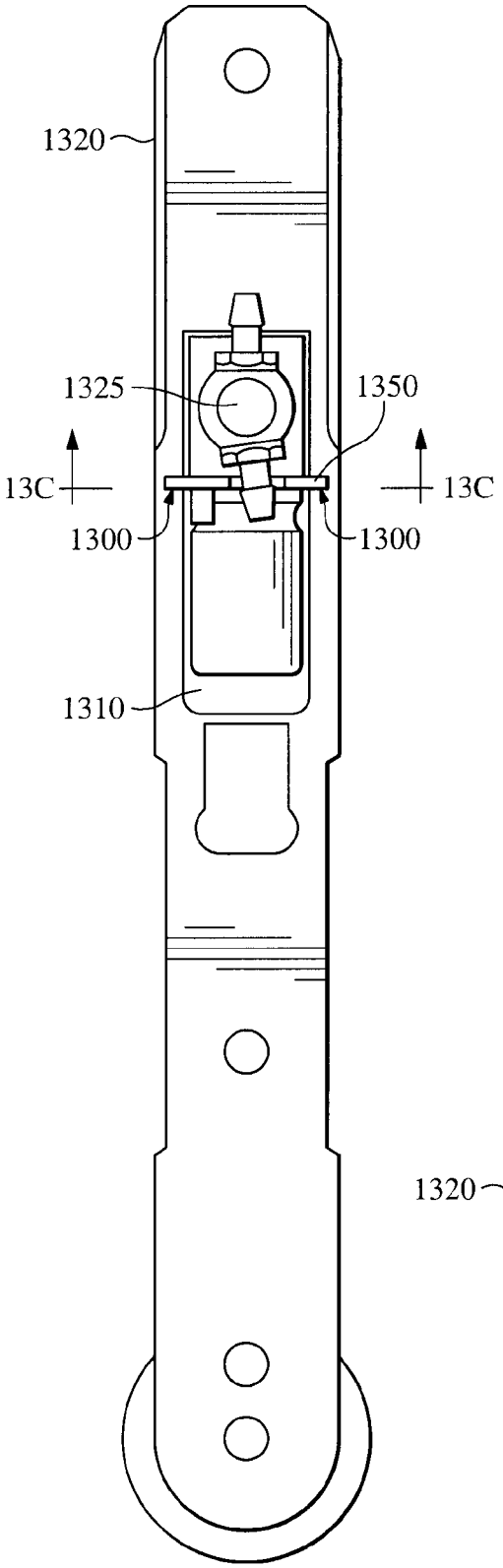
FIG. 13A is a somewhat schematic top view of a paintball gun grip frame configured to receive a grip-mounted circuit board.
Figure 13B:
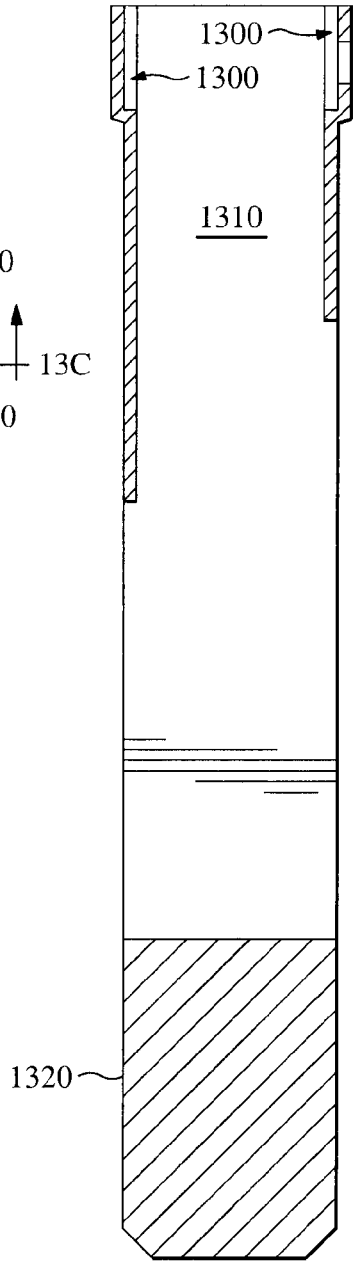
FIG. 13B is a somewhat schematic cross-sectional view of the paintball gun grip frame of FIG. 13A, illustrating a slot configured to receive a grip-mounted circuit board.
Figure 13C:
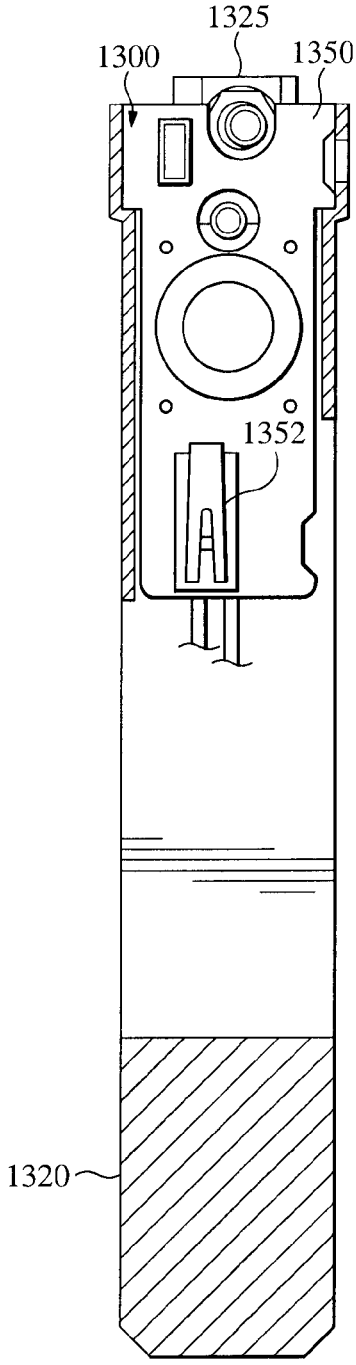
FIG. 13C is a somewhat schematic cross-sectional view of the paintball gun grip frame of FIG. 13A, illustrating a grip-mounted circuit board arranged in the slot of FIG. 13B.
Figure 14:
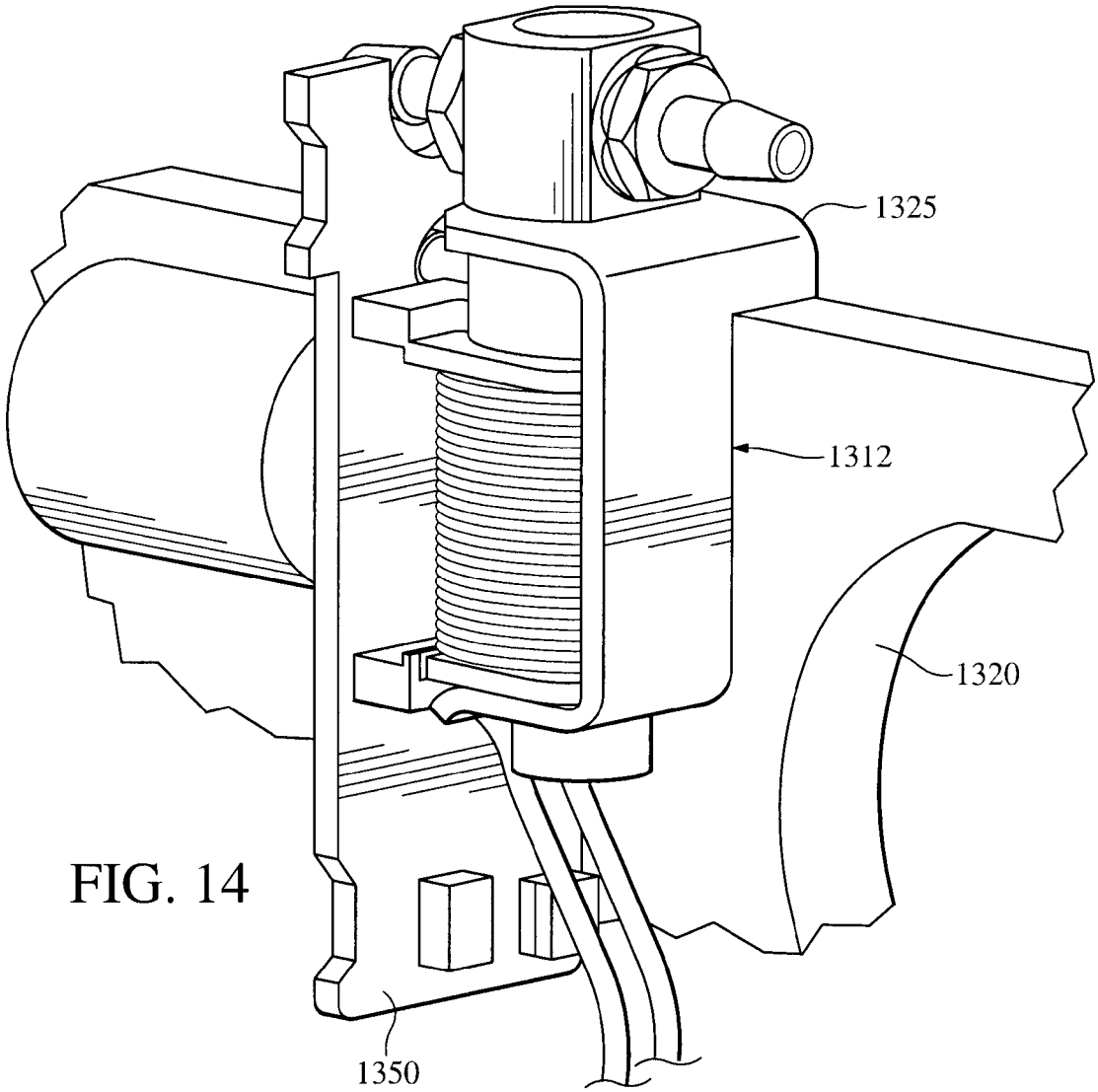
FIG. 14 is a somewhat schematic cross-sectional perspective view of a paintball gun having a grip-mounted circuit board with a solenoid valve arranged thereon.
Figure 15:
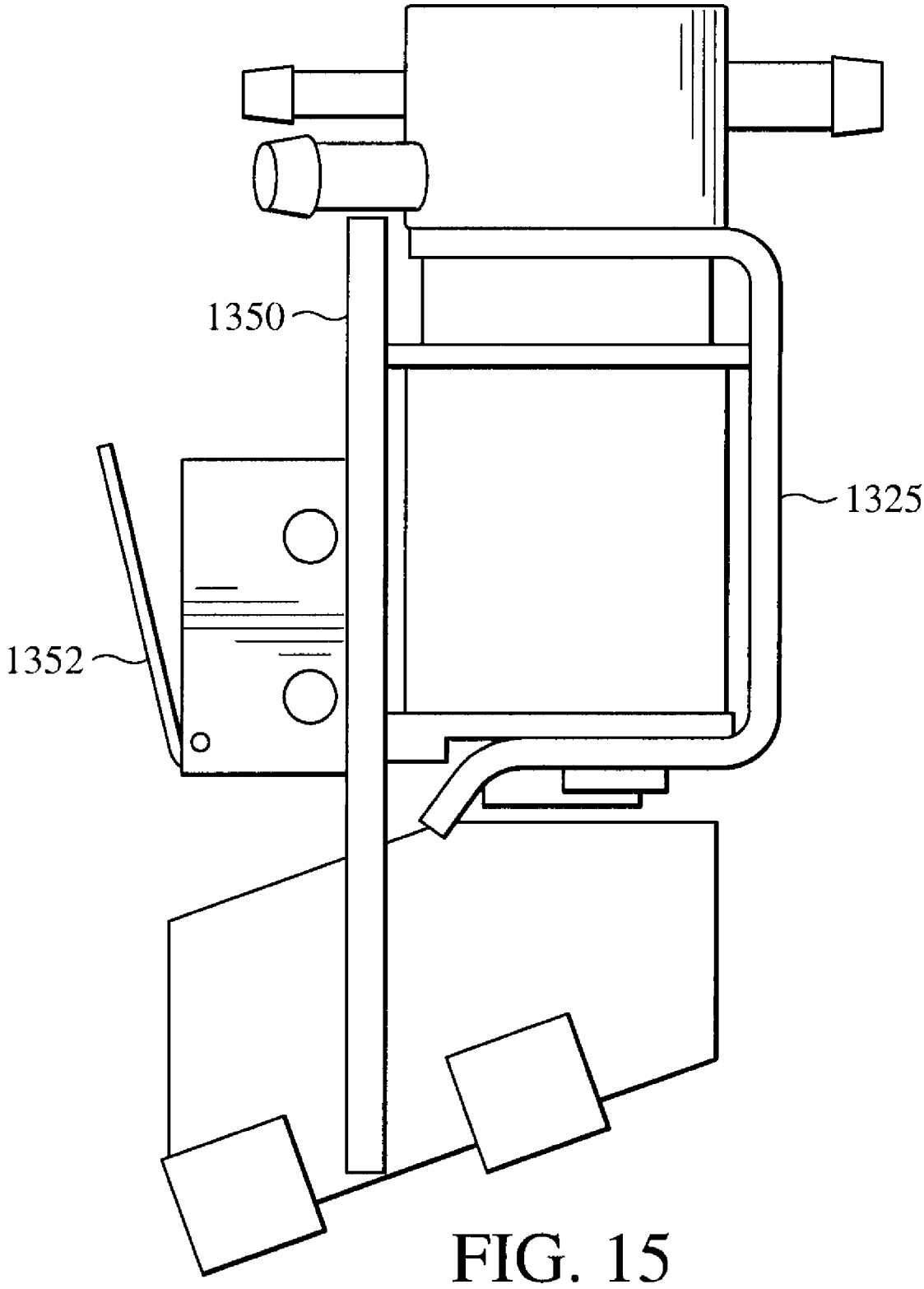
FIG. 15 is a somewhat schematic side view of a circuit board for a paintball gun having a solenoid valve and trigger-actuated microswitch arranged thereon.

FIGS. 11-12 illustrate another aspect of the earlier-described invention. Referring to FIGS. 11-12, according to a further aspect of this invention, an interchangeable shell 1100 can form the outer portion of the paintball gun body surrounding the pneumatic components 1115. The interchangeable shell 1100 can, for instance, be a plastic, metal, or composite material, but is preferably ABS plastic. A number of interchangeable shells can be provided of different shapes, colors, and body styles to permit a user to customize their gun to a desired appearance. The shell 1100 can be mounted to the grip frame, for instance, through one or more screws or other mounting device. The pneumatic components 1115 can be configured to slide into the external shell 1100 through a forward opening 1100*a* thereof.

FIGS. 13A-15 illustrate yet another aspect of the earlier-described invention. Referring to FIGS. 13A-15, an improved apparatus and method for grip mounting a circuit board 1350 can be provided. According to this method, one or more slots 1300 are arranged in the grip frame to receive the circuit board. Most preferably, one slot 1300 is arranged on each side of an opening 1310 on the inside of the grip frame 1320 to receive opposing sides of the circuit board 1350. The depth of the slots 1300 is preferably selected to arrange the circuit board 1350 in the appropriate location when the circuit board 1350 is fully inserted into the slots 1300. The circuit board 1350 and slot 1300 may further have a mating step-like configuration. In this embodiment, no tools or mounting screws are required to secure the circuit board 1350 in the paintball gun, thereby reducing the cost of parts and the cost of manufacturing. Manufacturing consistency is also improved.

A solenoid valve 1325 is preferably mounted on the circuit board 1350 and arranged in the grip 1320 of the paintball gun. A slot 1312 in the grip is preferably sized to securely receive both the circuit board 1350 and the solenoid valve 1325. The circuit board 1350 can further include a trigger-actuated microswitch 1352 arranged on the circuit board 1350, preferably on an opposite side of the circuit board 1350 from the solenoid valve 1325.

Figure 16:
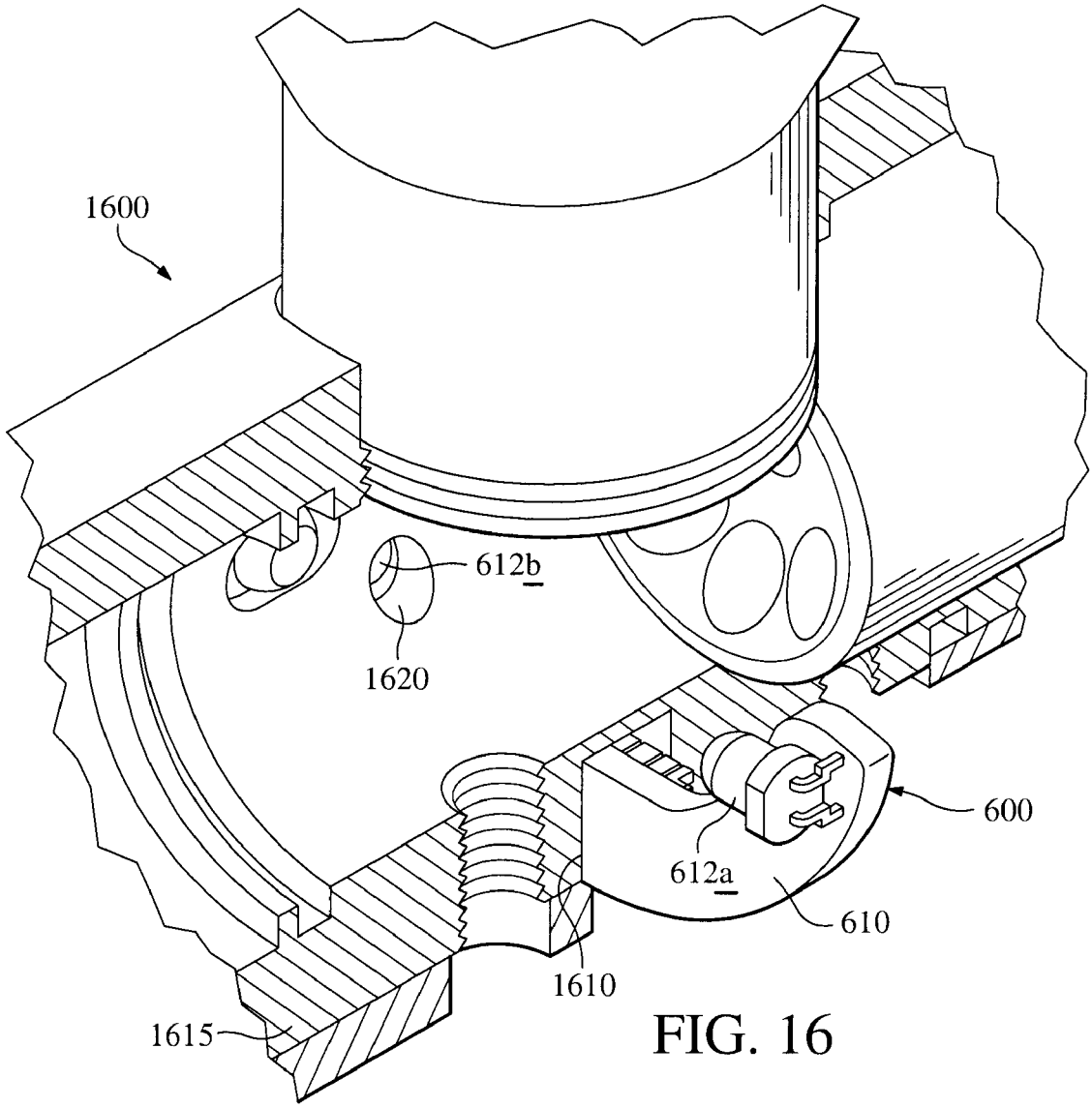
FIG. 16 is a somewhat schematic cross-sectional perspective view of a paintball gun having the paintball detection system of FIGS. 6-9, illustrating a method of mounting the paintball detection system.

FIG. 16 is a cross-sectional perspective view of a section of a paintball gun 1600 illustrating a method of mounting a paintball detection system 600 according to another aspect of the earlier-described invention. A method of mounting a paintball detection system 600 is provided. According to this method, a mounting slot 1610 is preferably arranged in a bottom portion of a pneumatic housing 1615 near a breech area of a paintball gun 1600. Holes or slots 1610 are preferably arranged through one or more sidewalls of the pneumatic housing 1615 at the breech area. A paintball detection system circuit board 610 is preferably mounted within the slot 1610 such that a sensor 612*a* disposed on the circuit board 610 can communicate with an interior of the breech area or with a sensor 612*b* arranged on an opposite side of the pneumatic housing 1615. The circuit board 610 is preferably shaped to fit within the mounting slot 1610. If a break-beam sensor system is used, holes 1620 are preferably arranged in opposing sides of the pneumatic housing 1615 in proximity to the location of the break-beam sensors once installed in the pneumatic housing 1615.

Figure 17:
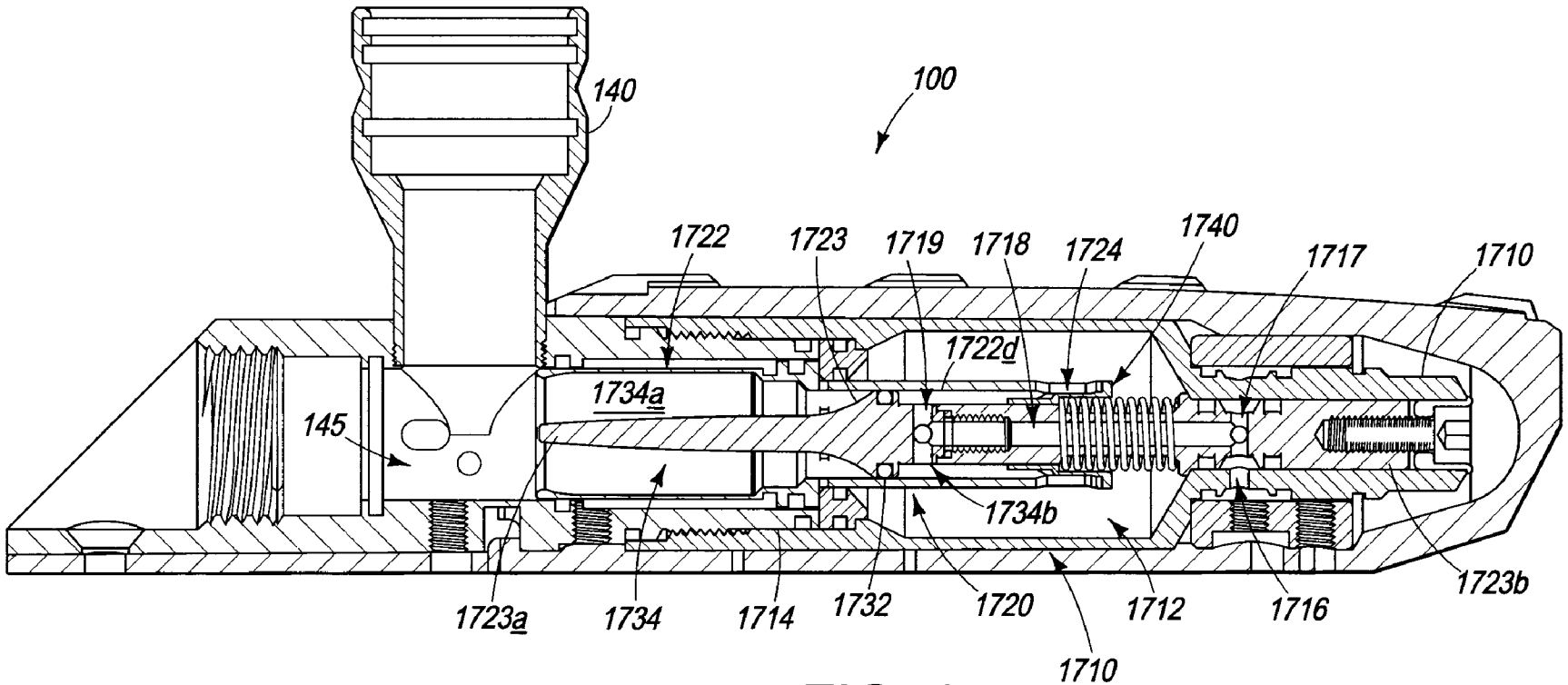
FIG. 17 is a somewhat schematic cross-sectional side view of a paintball gun body having an improved bolt configuration according to one embodiment of the present invention, with the bolt arranged in a rearward (open) position.
Figure 18:
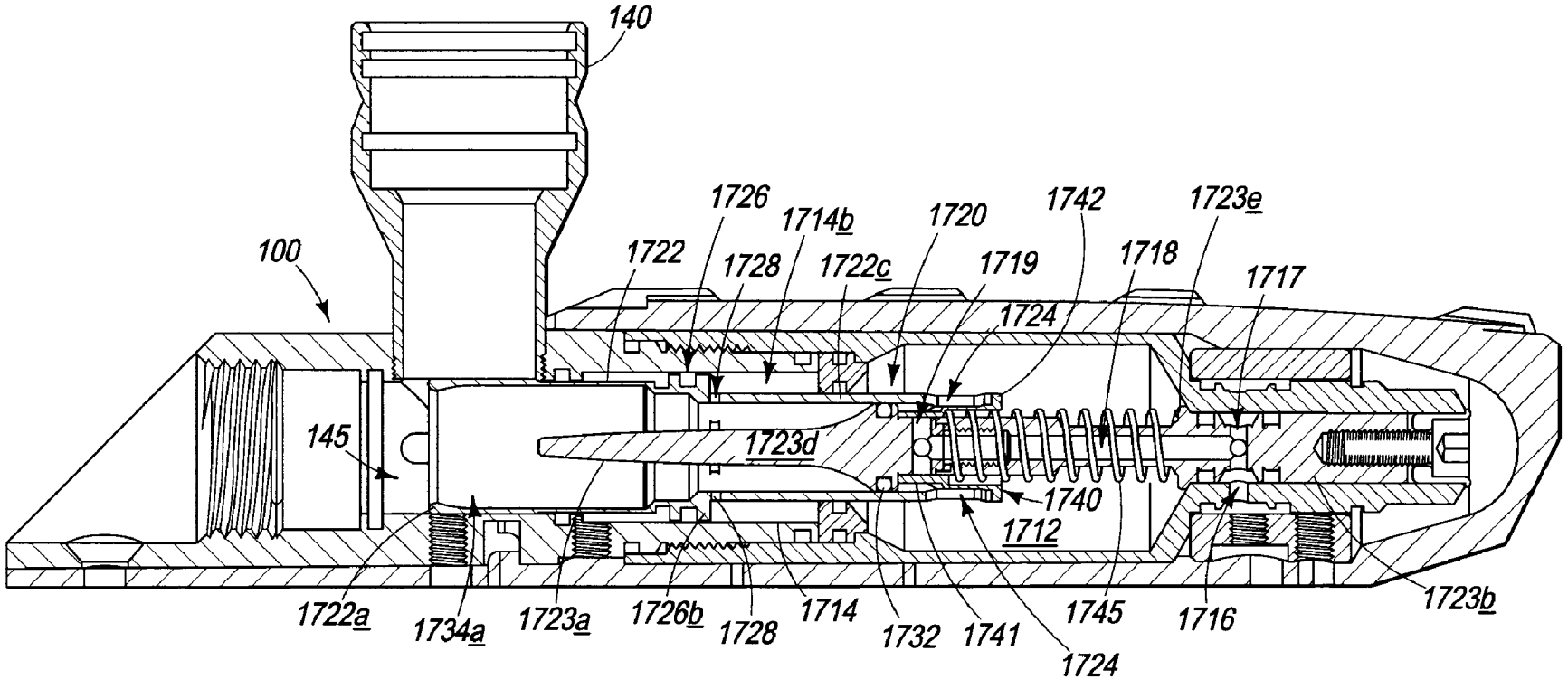
FIG. 18 is an enlarged, somewhat schematic cross-sectional side view of the paintball gun body of FIG. 17, shown with the bolt arranged in a transitional position, with the flow control member arranged in a closed position.
Figure 19:
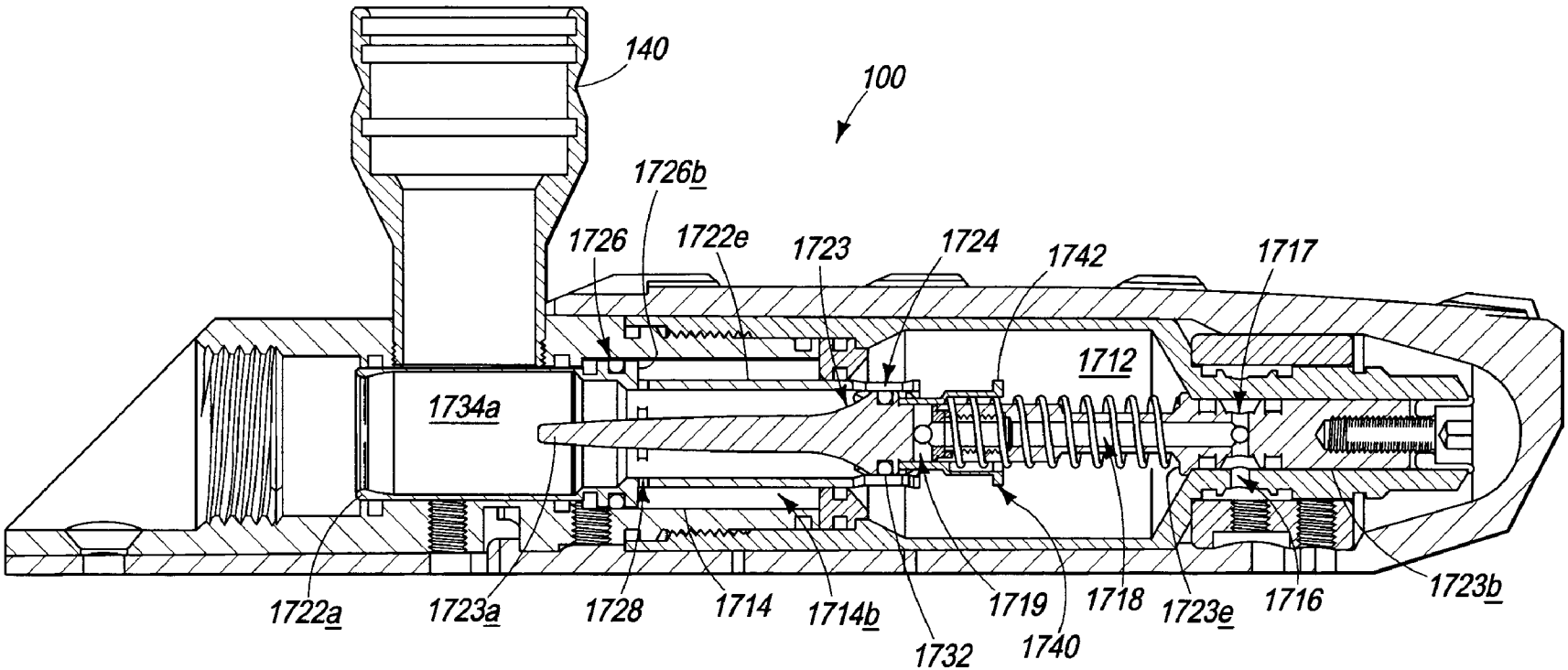
FIG. 19 is an enlarged, somewhat schematic cross-sectional side view of the paintball gun body of FIGS. 17 and 18, shown with the bolt arranged in a forward (closed) position and the flow control member arranged in a closed position.
Figure 20:
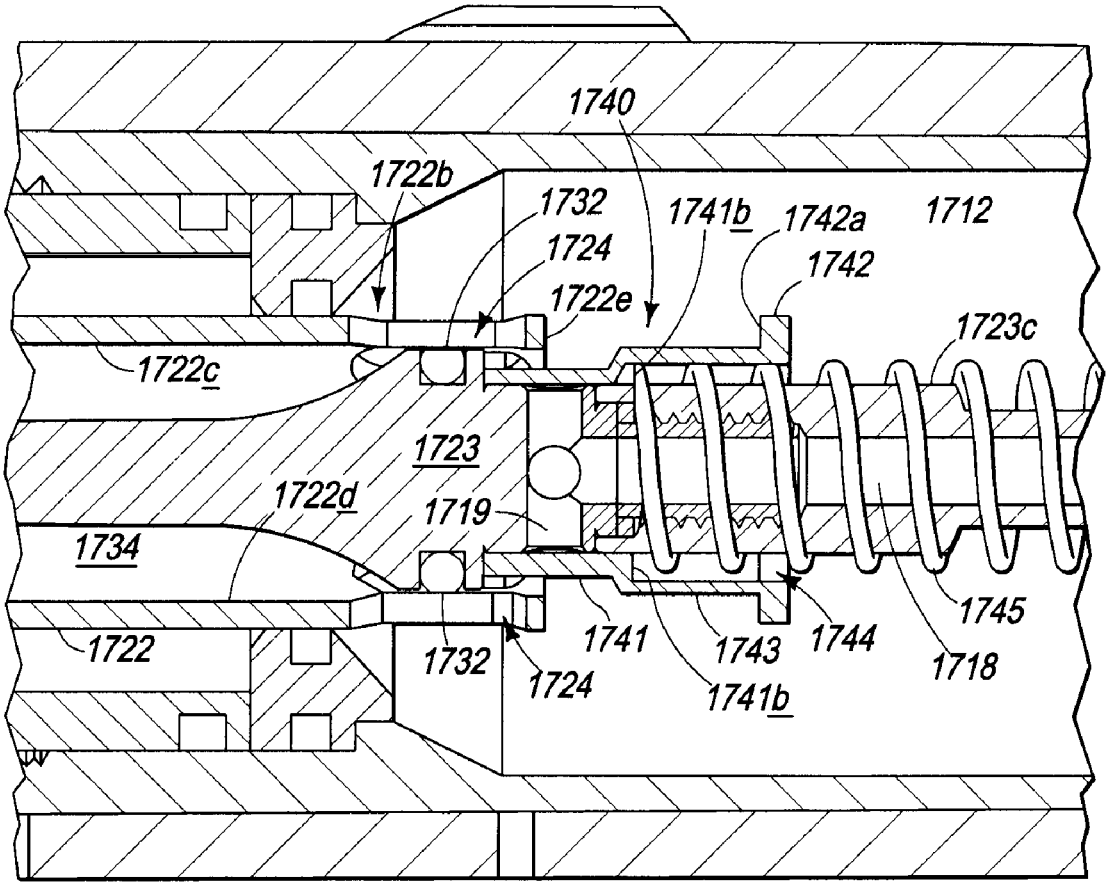
FIG. 20 is an enlarged cross-sectional side view of a selected portion of the paintball gun body of FIG. 19, focusing on the flow control member.

FIG. 17 is a somewhat schematic cross-sectional side view of a paintball gun body 100 having an improved bolt and firing valve assembly 1720 according to one embodiment of the present invention, with the bolt 1722 arranged in a rearward (open) position. FIG. 18 is an enlarged cross-sectional side view showing the bolt 1722 arranged in a transitional position, with a flow control member 1740 arranged in a closed position. And FIG. 19 is also an enlarged cross-sectional side view showing the bolt 1722 arranged in a forward (closed) position, again with the flow control member 1740 arranged in a closed position. FIG. 20 is an enlarged cross-sectional side view of a selected portion of the paintball gun body 100 of FIG. 19, focusing on the flow control member 1740.

Referring to FIGS. 17-20, in one embodiment of the present invention, an improved bolt assembly 1720 for a pneumatic paintball gun 100 can include a valve stem 1723, a moveable bolt 1722, and a moveable flow control member 1740. The valve stem 1723 can be attached to a rearward portion 1710*a* of the pneumatic housing 1710 of the paintball gun 100 through a threaded or other mechanical connection.

The valve stem 1723 preferably comprises an inlet port 1717 that receives compressed gas from a compressed gas supply port 1716 and communicates it into an internal passage 1718 of the valve stem 1723. The internal passage 1718 preferably communicates the compressed gas from the inlet port 1717 to an outlet port 1719. The outlet port 1719 is preferably arranged in the valve stem 1723 forward of the inlet port 1717 to communicate the compressed gas from the internal passage 1718 into a rearward portion 1734*b* of an internal bolt chamber 1734. A sealing member 1732 is preferably arranged near a forward end 1723*a* of the valve stem 1723 surrounding an outer perimeter of the valve stem 1723.

The forward end 1723*a* of the valve stem 1723 may include a tapered portion 1723*d* that transitions gradually from the sealing member 1732 to a breech area 145 of the paintball gun 100. The tapered portion 1723*d*, for instance, can transition from a diameter that is nearly as large as the internal diameter of the rearward internal bolt chamber 1734*b* down to a diameter less than half that size (or smaller). This can improve the flow characteristics of the compressed gas as it leaves the bolt 1722.

The bolt 1722 is preferably mounted on the valve stem 1723 and configured to slide between a rearward (open or loading) position and a forward (closed or firing) position to operate the pneumatic paintball gun 100. The bolt 1722 is preferably a substantially hollow, cylindrical-like member having a plurality of ports 1724 arranged through a sidewall 1722*c* thereof. In a rearward position, compressed gas from the outlet port 1719 of the valve stem 1723 is communicated into the rearward portion 1734*b* of the internal chamber 1734 of the bolt 1722, and from there into a compressed gas storage area 1712 surrounding the bolt 1722 through the bolt ports 1724. In a forward position, the bolt ports 1724 preferably slide past (or at least partially past) the sealing member 1732 arranged on the valve stem 1723 to communicate the compressed gas from the compressed gas storage area 1714 into a forward passage 1734*a* of the bolt 1722 to launch a paintball from the paintball gun 100.

The bolt 1722 also preferably includes a forward and a rearward piston surface area 1726*a*, 1726*b*. A quantity of compressed gas is preferably selectively supplied and vented from the forward piston surface area 1726*a* using a mechanical or electro-pneumatic valving mechanism 250 (see, e.g., FIG. 1). When gas is supplied to the forward piston surface area 1726*a*, the bolt 1722 is held rearward in an open position. When gas is vented away from the forward surface area 1726*a*, compressed gas pressure from the compressed gas storage area 1712 urges the bolt 1722 forward into a firing position. The firing mechanism preferably consists of the valve stem sealing member 1732 arranged in communication with the inner surface 1722*d* of the bolt 1722. The bolt ports 1724 preferably provide one or more firing ports 1724 arranged to communicate compressed gas into a forward bolt chamber 1724*a* to launch a paintball when the bolt 1722 is in its firing position.

The flow of compressed gas into the compressed gas storage area 1712 can be restricted or prevented during a firing operation to increase gas efficiency of the paintball gun 100. More particularly, according to this embodiment, a flow control member 1740 is preferably slidably arranged on a central portion 1723*c* of the valve stem 1723. The flow control member 1740 is preferably configured to open and close the outlet port 1719 of the valve stem 1723 to permit and either cut off completely or restrict the flow of compressed gas into the compressed gas storage area 1712.

The bolt 1722 can be configured to urge the flow control member 1740 into a rearward (open) position when the bolt 1722 is in its open position. A rearward facing surface 1722*e* on the rearward portion 1722*b* of the bolt 1722, for instance, can communicate with a surface 1742*a* of a flange 1742 on the flow control member 1740 to force it rearward as the bolt 1722 opens. Alternatively, the flow control member 1740 can be integrally connected to or formed as part of the bolt 1722. When the flow control member 1740 is in its rearward position, the outlet port 1719 on the valve stem 1723 is open and permitted to communicate compressed gas into the internal bolt chamber 1734 (and hence the compressed gas storage area 1712 through bolt ports 1724).

Forward movement of the flow control member 1740 can either be directly linked to the movement of the bolt 1722, or can be driven separately by a biasing force such as a spring 1745. Of course, any other mechanical or pneumatic biasing force could also be used. The biasing force is preferably a pneumatic or spring force that is applied to the flow control member 1740 to urge it to a forward position when the bolt 1722 transitions to its forward position. In the embodiment shown in FIGS. 17-20, a spring force is applied by a biasing spring 1745 to a rearward facing surface area 1741*b* of the flow control member 1740. The biasing spring 1745 can, for instance, be arranged on the central portion 1723*c* of the valve stem 1723 between a forward facing surface 1723*e* of the valve stem 1723 and the rearward facing surface 1741*b* of the flow control member 1740. The spring 1745 is preferably received in a spring receptacle 1744 formed by an outwardly expanded sidewall 1743 of the flow control member 1740.

In the forward position, the closing member 1741 of the flow control member 1740 can either cut off entirely or substantially restrict the supply of compressed gas from the outlet port 1719. The closing portion 1741 (in this case a sidewall) of the flow control member 1740 can, for example, occlude the outlet port 1719. In this manner, compressed gas can be selectively supplied into the compressed gas storage chamber 1712 during a loading operation and prevented from entering the compressed gas storage chamber 1712 during a firing operation, thereby improving gas efficiency.

Referring additionally to FIG. 1, in operation, compressed gas is preferably supplied to a paintball gun 100 incorporating the improved bolt 1722 from a compressed gas source (not shown) through a pressure regulator 130. The compressed gas is preferably directed from the pressure regulator 130 to a supply port 1716 that communicates with the inlet port 1717 of the valve stem 1723 for feeding the compressed gas storage area 1712. The compressed gas supplied to the supply port 1716 can come directly from the pressure regulator 130 or can be transmitted via a valving mechanism 250. Compressed gas supplied to the valve stem 1723 is preferably transmitted through the internal passage 1718 in the valve stem 1723 to the outlet port 1719.

A quantity of compressed gas supplied to the valving mechanism 250 can be selectively transferred through the valving mechanism 250 to the forward surface area 1726*a* of the bolt piston 1726. When the valving mechanism 250 is in a neutral (non-actuated) position, the compressed gas is preferably supplied to the forward bolt piston 1726*a* surface area to force the bolt 1722 into a rearward position. While the bolt 1722 is in a rearward position, a paintball is allowed to load into a breech 145 of the paintball gun 100 from the feed tube 140. In addition, while the bolt 1722 is held rearward, the flow control member 1740 is preferably held open to permit the gas outlet port 1719 in the valve stem 1723 to transmit compressed gas into the compressed gas storage area 1712 via the bolt's rearward internal chamber 1734*b*.

A trigger mechanism 102 is preferably configured to operate the valving mechanism 250. When the trigger 102 is depressed, the valving mechanism 250 is preferably actuated to vent compressed gas away from the forward piston surface area 1726*a* of the bolt 1722. A force, such as a pneumatic and/or mechanical force, is preferably applied to a rearward surface area 1722*e* of the bolt 1722. The rearward surface area 1722*e* of the bolt 1722 can be arranged, for example, in the compressed gas storage area 1712. The pneumatic force applied to the rearward surface area 1722*e* of the bolt 1722 can thereby be supplied from the compressed gas storage area 1712. The biasing member 1745 can also provide a force on the rearward bolt surface area 1722*e* through the flow control member 1740 to urge the bolt 1722 forward. When compressed gas is vented from the forward bolt piston surface area 1726*a*, the force(s) applied to the rearward bolt surface area 1722*e* cause the bolt 1722 to move to a forward position.

When the bolt 1722 transitions to its forward position, the bolt ports 1724 (preferably arranged near a rearward end 1722*b* of the bolt 1722) transition past (or partially past) the sealing member 1732 arranged on the valve stem 1723. Compressed gas from the compressed gas storage area 1712 is thereby permitted to enter a forward bolt passage 1734*a* through the bolt firing ports 1724 to launch a paintball from the marker 100. In addition, as the bolt 1722 transitions to the firing position, the flow control member 1740 is permitted to move forward under the influence of a biasing force. When the flow control member 1740 moves forward, it preferably closes off the outlet port 1719 and blocks (or restricts) the flow of compressed gas from the valve stem 1723 into the compressed gas storage area 1712.

The valving mechanism 250 can be a solenoid valve (such as a three-way, four-way, or other solenoid valve), a mechanical valve, or other valving mechanism. In the case of a solenoid valve 250, an electronic circuit 150 is preferably provided to control the operation of the solenoid valve 250 based on actuation of a trigger mechanism 102. A switch 152, such as a microswitch or other switching device, is preferably arranged in communication with the trigger 102 to send an actuation signal to the electronic circuit 150 in response to a pull of the trigger 102. A power source 122 is also preferably provided to supply power to the electronic circuit 150 and solenoid valve 250. The valving mechanism 250 preferably vents compressed gas away from a forward bolt piston surface area 1726*a* in response to a firing signal from the circuit board 150. In the case of a mechanical valve, the mechanical valve preferably communicates with the trigger 102 to vent the compressed gas away from the forward bolt piston surface area 1726*a* in response to a trigger pull.

In one embodiment, vent ports 1728 can also be arranged through sidewalls 1722*c* of the bolt 1722 behind a rearward surface 1726*b* of the pneumatic piston 1726 to prevent pressurized gas buildup in the rearward chamber area 1714*b* of the pneumatic cylinder 1714 behind the bolt piston 1726. The chamber area 1714*b* in communication with the rearward piston surface 1726*b* of the bolt 1722 can thereby be vented to atmosphere through the forward internal bolt passage 1734*a*. This reduces the force necessary to drive the bolt 1722 to its rearward position.

Having described and illustrated various principles of the present invention through descriptions of exemplary preferred embodiments thereof, it will be readily apparent to those skilled in the art that these embodiments can be modified in arrangement and detail without departing from the inventive principles made apparent herein. The claims should therefore be interpreted to cover all such variations and modifications.

What is claimed is:

1. A bolt assembly for a paintball gun comprising a compressed gas storage chamber, said bolt assembly comprising:

a valve stem comprising a gas supply passageway arranged longitudinally through the valve stem and a port communicating between the passageway and an exterior of the valve stem for supplying compressed gas to a compressed gas storage chamber arranged in the paintball gun;

a bolt slidably mounted on the valve stem and comprising one or more bolt ports configured to communicate compressed gas from the compressed gas storage chamber to a forward end of the bolt for launching a paintball when the bolt is arranged in a second position;

a sealing member arranged in communication with a surface of the bolt, wherein the sealing member is configured to prevent compressed gas in the compressed gas storage chamber from entering a forward bolt chamber when the bolt is in a first position and to permit compressed gas to enter the forward bolt chamber through the bolt ports when the bolt is in a second position; and a flow control member slidably arranged on an external surface of the valve stem and configured to slide between a first position and a second position to permit a flow of compressed gas from the valve stem port into the compressed gas storage chamber when the flow control member is in the first position and to occlude the valve stem port to cut off or restrict the flow of compressed gas from the valve stem port into the compressed gas storage chamber when the flow control member is in the second position.

2. A bolt assembly according to claim 1, further comprising:

a biasing member applying a force to a surface of the flow control member to bias the flow control member toward the second position.

3. A bolt assembly according to claim 2, wherein the bolt applies a force to a surface of the flow control member to drive it toward the first position.

4. A bolt assembly according to claim 1, wherein the valve stem further comprises a tapered forward end that extends at least halfway into the forward bolt chamber when the bolt is in a rearward position.

5. A bolt assembly according to claim 4, wherein the tapered forward end of the valve stem extends at least substantially through an entire length of the forward bolt chamber when the bolt is in the rearward position.

6. A bolt assembly according to claim 1, wherein the bolt assembly is arranged in a pneumatic housing of a paintball gun.

7. A bolt assembly according to claim 6, wherein the valve stem is rigidly affixed to the pneumatic housing.

8. A bolt assembly according to claim 6, wherein the pneumatic housing comprises a supply port that supplies compressed gas into an input port of the valve stem.

9. A bolt assembly according to claim 8, wherein the port of the valve stem receives compressed gas from the valve stem input port and supplies it to the compressed gas storage chamber through the bolt ports.

10. A bolt assembly according to claim 2, where the biasing member is a spring arranged on the valve stem that communicates with a rearward facing surface of the flow control member.

11. A bolt assembly for a paintball gun, comprising:

a valve stem configured to be arranged in a fixed relationship with respect to a paintball gun during operation of the paintball gun, said valve stem comprising:

an inlet port configured to receive compressed gas from a compressed gas supply during operation of the paintball gun;

an outlet port configured to supply compressed gas from the inlet port into a compressed gas storage area of the paintball gun during operation of the paintball gun; and a transfer port configured to transfer compressed gas from the inlet port to the outlet port;

a bolt slidably mounted on the valve stem and configured to slide between a first position and a second position during operation of the paintball gun;

one or more bolt ports arranged through a sidewall of the bolt, wherein during operation of the paintball gun, the bolt ports are located in proximity to the compressed gas storage area and configured to slide at least partially across a sealing member arranged on the valve stem to release compressed gas from the compressed gas storage area from the paintball gun; and a flow control member arranged in proximity to the outlet port of the valve stem, wherein said flow control member is arranged to occlude the outlet port and restrict the supply of compressed gas from the outlet port into the compressed gas storage area when the bolt is arranged in the second position.

12. A bolt assembly according to claim 11, wherein the flow control member is slidably arranged on the valve stem and configured to move between an open and a closed position.

13. A bolt assembly according to claim 12, further comprising a biasing member configured to bias the flow control member toward the closed position.

14. A bolt assembly according to claim 13, wherein the biasing member comprises a spring arranged on a rearward portion of the valve stem.

15. A bolt assembly according to claim 11, wherein the bolt contacts and applies a force to a surface of the flow control member to hold the flow control member in an open position when the bolt is in its first position, and wherein compressed gas is supplied from the outlet port into the compressed gas storage area through the one or more bolt ports.

16. A bolt assembly for a paintball gun, comprising:

a valve stem arranged in a pneumatic housing of a paintball gun, said valve stem comprising a port for supplying compressed gas into a compressed gas storage area of the paintball gun;

a bolt slidably mounted on the valve stem and configured to move between a first and a second position during operation of the paintball gun; and a separate flow control member slidably arranged on an external surface of the valve stem and configured to move between an open and a closed position, wherein during operation of the paintball gun, the flow control member operates as a valving mechanism to permit compressed gas to enter a compressed gas storage area of the paintball gun when in the open position and to restrict or prevent compressed gas from entering the compressed gas storage area of the paintball gun when in the closed position.

17. A bolt assembly according to claim 16, wherein the flow control member comprises a cylindrical tube that is slidably arranged on the valve stem in the paintball gun in proximity to the port, and is configured to slide between an open position in which the port can freely transmit compressed gas to the compressed gas storage area and a closed position in which the flow control member occludes the port to restrict or prevent the supply of compressed gas into the compressed gas storage area of the paintball gun.

18. A bolt assembly according to claim 17, further comprising a biasing member configured to bias the flow control member toward the closed position.

19. A bolt assembly according to claim 18, wherein a surface of the bolt is arranged to contact a surface of the flow control member to hold the flow control member in an open position when the bolt is in the first position.

20. A bolt assembly according to claim 16, wherein the bolt is comprises a plurality of bolt ports configured to slide at least partially across a sealing member arranged on the valve stem to release compressed gas from the compressed gas storage area; and wherein the flow control member is configured to occlude the port arranged in the valve stem when the flow control member is in the closed position.

* * * * *